US009360238B2

(12) United States Patent
Kobayashi et al.

(10) Patent No.: US 9,360,238 B2
(45) Date of Patent: Jun. 7, 2016

(54) REFRIGERATING APPARATUS

(71) Applicant: PANASONIC HEALTHCARE HOLDINGS CO., LTD., Tokyo (JP)

(72) Inventors: Susumu Kobayashi, Osaka (JP); Jiro Yuzawa, Osaka (JP); Satoshi Okuda, Osaka (JP); Hidetoshi Shinya, Osaka (JP); Tadahisa Saga, Osaka (JP)

(73) Assignee: Panasonic Healthcare Holdings Co., Ltd., Tokyo (JP)

( * ) Notice: Subject to any disclaimer, the term of this patent is extended or adjusted under 35 U.S.C. 154(b) by 195 days.

(21) Appl. No.: 14/163,968

(22) Filed: Jan. 24, 2014

(65) Prior Publication Data

US 2014/0182327 A1 Jul. 3, 2014

Related U.S. Application Data

(60) Division of application No. 12/835,568, filed on Jul. 13, 2010, now abandoned, which is a continuation of application No. PCT/JP2009/064594, filed on Aug. 20, 2009.

(30) Foreign Application Priority Data

Sep. 10, 2008 (JP) ..... 2008-232495

(51) Int. Cl.
*F25B 7/00* (2006.01)
*F25D 11/04* (2006.01)
(Continued)

(52) U.S. Cl.
CPC . *F25B 7/00* (2013.01); *F25B 9/006* (2013.01); *F25D 11/04* (2013.01); *F25D 17/047* (2013.01);
(Continued)

(58) Field of Classification Search
CPC ..... F25B 7/00; F25B 9/006; F25D 23/061; F25D 23/025; F25D 11/04; F28D 1/0426; F28D 1/0477; F28D 7/087
See application file for complete search history.

(56) References Cited

U.S. PATENT DOCUMENTS 2,730,872 A * 1/1956 Hall ..... F25B 39/02 62/518
2,773,362 A * 12/1956 Scheitlin ..... F25D 11/04 184/27.1

(Continued)

FOREIGN PATENT DOCUMENTS

JP 3-158683 A 7/1991
JP 4-46667 A 4/1992

(Continued)

OTHER PUBLICATIONS

Patent Abstracts of Japan for patent application with Publication No. 2003-013049, Publication Date: Jan. 15, 2003, 1 page.

(Continued)

*Primary Examiner* — Mohammad M Ali
*Assistant Examiner* — Christopher R Zerphey
(74) *Attorney, Agent, or Firm* — McDermott Will & Emery LLP

(57) ABSTRACT

A refrigerating apparatus includes an insulation housing including an inner box. The inner box has side plates and first and second refrigerating circuits including a first evaporation pipe and a second evaporation pipe, respectively. The first and second evaporation pipes are disposed on the side plates. The first and second evaporation pipes are bent so as to form a first comb shape and a second comb shape, respectively. The first and the second comb shapes form a nested structure. The first and second evaporation pipes include a first straight portion and a second straight portion extending the horizontal direction, respectively. A first distance between the first straight portion of the first evaporation pipe and the first straight portion of the second evaporation pipe and a second distance between the first straight portion of the second evaporation pipe and the second straight portion of the second evaporation pipe are substantially equal.

17 Claims, 17 Drawing Sheets

(51) Int. Cl.

| | |
|---|---|
| ***F28D 1/04*** | (2006.01) |
| ***F25B 9/00*** | (2006.01) |
| ***F25D 17/04*** | (2006.01) |
| ***F25D 23/02*** | (2006.01) |
| ***F25D 23/06*** | (2006.01) |

(52) U.S. Cl.

CPC ..... *F25D 23/025* (2013.01); *F25D 23/061* (2013.01); *F28D 1/0426* (2013.01); *F25D 2201/14* (2013.01)

(56) References Cited

U.S. PATENT DOCUMENTS

| | | | | |
|---|---|---|---|---|
| 3,203,194 | A | 8/1965 | Fuderer | |
| 3,605,431 | A * | 9/1971 | Carson | A47J 41/005 62/190 |
| 3,733,845 | A | 5/1973 | Lieberman | |
| 3,907,267 | A * | 9/1975 | Griffiths | B23P 15/26 269/47 |
| 4,788,829 | A * | 12/1988 | Takemasa | F25B 5/00 62/113 |
| 5,265,443 | A | 11/1993 | Yuzawa et al. | |
| 5,694,779 | A | 12/1997 | Matsushima et al. | |
| 6,128,914 | A | 10/2000 | Tamaoki et al. | |
| 6,622,518 | B2 | 9/2003 | Park | |
| 6,804,976 | B1 * | 10/2004 | Dain | F25B 39/02 165/148 |
| 2002/0002838 | A1 * | 1/2002 | Kim | F25D 11/022 62/440 |
| 2004/0177636 | A1 * | 9/2004 | Jolly | F24D 3/14 62/259.1 |
| 2006/0123805 | A1 * | 6/2006 | Yuzawa | C09K 5/045 62/114 |
| 2011/0197623 | A1 * | 8/2011 | Ascani | F25D 23/061 62/441 |

FOREIGN PATENT DOCUMENTS

| | | | |
|---|---|---|---|
| JP | 04-288451 | A | 10/1992 |
| JP | 07-146013 | A | 6/1995 |
| JP | 10-300330 | A | 11/1998 |
| JP | 11-304338 | A | 11/1999 |
| JP | 2000-146330 | A | 5/2000 |
| JP | 2001-108333 | A | 4/2001 |
| JP | 2002-130888 | A | 5/2002 |
| JP | 2003-13049 | A | 1/2003 |
| JP | 2006-071233 | A | 3/2006 |
| JP | 2006-105314 | A | 4/2006 |
| JP | 2007-107858 | A | 4/2007 |

OTHER PUBLICATIONS

Mechanical English Translation of Japanese patent application with Publication No. 2003-013049, Publication Date: Jan. 15, 2010, 7 pages.

Patent Abstracts of Japan for patent application with Publication No. 03-158683, Publication Date: Jul. 8, 1991, 1 page.

Patent Abstracts of Japan for patent application with Publication No. 2000-146330, Publication Date: May 26, 2000, 1 page.

Mechanical English Translation of Japanese patent application with Publication No. 2000-146330, Publication Date: May 26, 2000, 24 pages.

Patent Abstracts of Japan for patent application with Publication No. 11-304338, Publication Date: Nov. 5, 1999, 1 page.

Mechanical English Translation of Japanese patent application with Publication No. 11-304338, Publication Date: May 11, 1999, 5 pages.

Patent Abstracts of Japan for patent application with Publication No. 2001-108333, Publication Date: Apr. 20, 2001, 1 page.

Mechanical English Translation of Japanese patent application with Publication No. 2001-108333, Publication Date: Apr. 20, 2001, 5 pages.

Patent Abstracts of Japan for patent application with Publication No. 2007-107858, Publication Date: Apr. 26, 2007, 1 page.

Mechanical English Translation of Japanese patent application with Publication No. 2007-107858, Publication Date: Apr. 26, 2007, 10 pages.

English Abstract from espacenet.corn for Japanese Patent No. 10300330, Publication Date: Nov. 13, 1998, 1 page.

Japanese Office Action issued in JP 2008-231256.

Japanese Office Action issued in JP 2008-205990.

Non-Final Office Action issued in U.S. Appl. No. 12/835,568 dated Aug. 8, 2013.

* cited by examiner

REFRIGERATING APPARATUS

CROSS-REFERENCE TO RELATED APPLICATIONS

This is a divisional application of Continuation application Ser. No. 12/835,568 filed on Jul. 13, 2010 of International Patent Application No. PCT/JP2009/064594 filed on Aug. 20, 2009, which claims the benefit of priority to Japanese Patent Application No. 2008-232495, filed on Sep. 10, 2008. The full contents of which are incorporated herein by reference.

BACKGROUND OF THE INVENTION

1. Field of the Invention

The present invention relates to a refrigerating apparatus.

2. Description of the Related Art

A refrigerating apparatus provided with a refrigerant circuit having a compressor, a condenser, an evaporator, and a heat exchanger in which nonazeotropic refrigerant mixture having a first refrigerant and second and third refrigerants with boiling points (evaporation temperatures) lower than a boiling point of the first refrigerant is sealed is known (e.g., see Japanese Patent Laid-Open No. 2003-13049).

The first refrigerant has, for example, a boiling point at which the refrigerant is liquefied when cooled by the condenser. The second and third refrigerants have boiling points lower than that of the first refrigerant and, for example, even if they are cooled by the condenser, not an entirety of them will be liquefied and a major part will remain in a gas state. The first refrigerant is a component required for compression by the compressor in the nonazeotropic refrigerant mixture and circulates through the refrigerant circuit while containing oil in the compressor.

In the refrigerant circuit, even if the second and third refrigerants are compressed by the compressor and cooled by the condenser, since a temperature of air or the like used for the cooling is high, not an entirety of them will be liquefied and an amount of the refrigerant gasified by the evaporator will be limited, and thus a cooling ability is not sufficiently utilized. Thus, a heat exchanger is provided which is configured to cool the refrigerant before being supplied to the evaporator with the refrigerant which has been brought to a low-temperature and low-pressure state by being gasified at the evaporator.

That is, in order to liquefy the second refrigerant and the third refrigerant having evaporation temperatures lower than that of the first refrigerant, cooling is performed by the heat exchanger.

By configuring in a manner described above, the second refrigerant and the third refrigerant of lower evaporation temperatures can be evaporated by the evaporator, and a temperature of the evaporator can be decreased.

In the above-mentioned refrigerating apparatus, although the first refrigerant compressed by the compressor is, after being cooled and condensed (liquefied) by the condenser and decompressed by a decompressor, evaporated (gasified) by the evaporator, since the evaporation temperatures of the second refrigerant and the third refrigerant at that time are lower than that of the first refrigerant, even if the second refrigerant and the third refrigerant are cooled by the heat exchanger in an air-cooling manner, the temperatures of the refrigerants are not sufficiently decreased, and a non-liquefied refrigerant (refrigerant in a gas state) remains. Therefore, problems may arise such as evaporation amounts of the second refrigerant and the third refrigerant of lower evaporation temperatures is not sufficiently obtained in the evaporator and the temperature of the evaporator is not decreased to a desired temperature.

On the other hand, a refrigerating apparatus is known in which, in order to cool an inner box to be housed in an outer box in an insulated manner, a refrigerant circuit having a compressor, a condenser, a decompressor, and an evaporator is provided and in which an evaporation pipe constituting the evaporator is attached in a meandering state to an outside of the inner box except at an opening (e.g., see Japanese Patent Laid-Open No. H03-158683).

In this refrigerating apparatus, the inner box is in a rectangular parallelepiped shape having a back plate, both side plates, a top plate, and a bottom plate and opened on the front, and the refrigerant circuit except for an evaporation pipe is housed in a machine chamber below the inner box. The evaporation pipe is first attached to the outside of the top plate in a meandering manner, then attached in a meandering manner in which a back-and-forth structure extending on the outside from one of the side plates via the back plate to the other side plate and extending on the outside from the other side plate via the back plate to the one side plate is repeated from an upper side to a lower side, and lastly, it is attached to the outside of the bottom plate in a meandering manner.

This refrigerating apparatus is configured in such a manner that, as the low-temperature refrigerant supplied from the machine chamber flows gradually from the upper side to the lower side along the outside of the inner box, uneven temperature distribution in an inside of the inner box (in the storage) due to a tendency that a cooled air remains at the lower side by its own weight can be made uniform.

The inner box of the refrigerating apparatus disclosed in the above-mentioned Japanese Patent Laid-Open No. H03-158683 forms a rectangular parallelepiped shape. For example, a boundary portion between the one side plate and the back plate forms a right angle, and a boundary portion between the other side plate and the back plate also forms a right angle.

When a tubular evaporation pipe made of metal is to be attached to the boundary portion forming a right angle, it is extremely difficult to bend the evaporation pipe at aright angle while bringing the pipe into thermal contact with the portion and maintaining a constant conductance.

Thus, when the evaporation pipe is to be attached to the refrigerating apparatus, it is, for example, necessary to individually attach the evaporation pipes respectively to the outside of the one side plate, the back plate, and the other side plate of the inner box in advance and to connect opening end portions of the evaporation pipes of the adjacent plates to each other by welding or to connect the opening end portions via a joint having a shape contouring the boundary portion by welding. However, since such a welding process is not easy, there is a problem that a manufacturing cost of the refrigerating apparatus is increased.

Alternatively, for example, as for the orthogonal boundary portion and a portion in its vicinity, it is necessary to bend the evaporation pipe so as to form an arc shape while a predetermined gap is maintained without bringing the evaporation pipe into thermal contact with the portions. However, there is a problem that such a portion which is not in thermal contact causes uneven temperature distribution inside the storage and the bending process is not easy. Thus, the problem of the increased manufacturing cost of the refrigerating apparatus still remains. Even if the refrigerating apparatus provided with the refrigerant circuit in which the above nonazeotropic refrigerant mixture is sealed is employed, since the evaporation amounts of the second refrigerant and the third refrigerant are not sufficiently obtained, it is difficult to prevent the uneven temperature distribution inside the storage.

SUMMARY OF THE INVENTION

A refrigerating apparatus according to an aspect of the present invention, includes: an insulation housing including an inner box, the inner box having side plates; a first refrigerating circuit including a first compressor and a first evaporator constituted by a first evaporation pipe; and a second refrigerating circuit including a second compressor and second evaporator constituted by a second evaporation pipe, wherein: the first and second evaporation pipes are disposed on the side plates of the inner box, the first evaporation pipe is bent so as to form a first comb shape on the side plates and the second evaporation pipe is bent so as to form a second comb shape on the side plates, the first comb shape and the second comb shape forming a nested structure, and the first and second evaporation pipes are configured such that: the first evaporation pipe includes a first straight portion extending a horizontal direction, a second straight portion extending the horizontal direction and a corner portion connecting the first and second straight portions of the first evaporation pipe, the second evaporation pipe includes a first straight portion extending the horizontal direction, a second straight portion extending the horizontal direction and a corner portion connecting the first and second straight portions of the second evaporation pipe, in the nested structure, the first straight portion of the first evaporation pipe, the first straight portion of the second evaporation pipe, the second straight portion of the second evaporation pipe and the second straight portion of the first evaporation pipe are arranged in this order in a vertical direction, with spaces therebetween, and a first distance between the first straight portion of the first evaporation pipe and the first straight portion of the second evaporation pipe and a second distance between the first straight portion of the second evaporation pipe and the second straight portion of the second evaporation pipe are substantially equal.

The present invention has an object to suppress a cost of a refrigerating apparatus while its cooling efficiency is improved and further has an object to improve evenness in temperature distribution inside the refrigerating apparatus while attachment of an evaporation pipe to the apparatus is facilitated.

Other features of the present invention will become apparent from descriptions of this specification and of the accompanying drawings.

BRIEF DESCRIPTION OF THE DRAWINGS

For more thorough understanding of the present invention and advantages thereof, the following description should be read in conjunction with the accompanying drawings, in which.

DETAILED DESCRIPTION OF THE INVENTION

At least the following details will become apparent from descriptions of this specification and of the accompanying drawings.

First Embodiment

Configuration of a Refrigerating Apparatus

Figure 1:
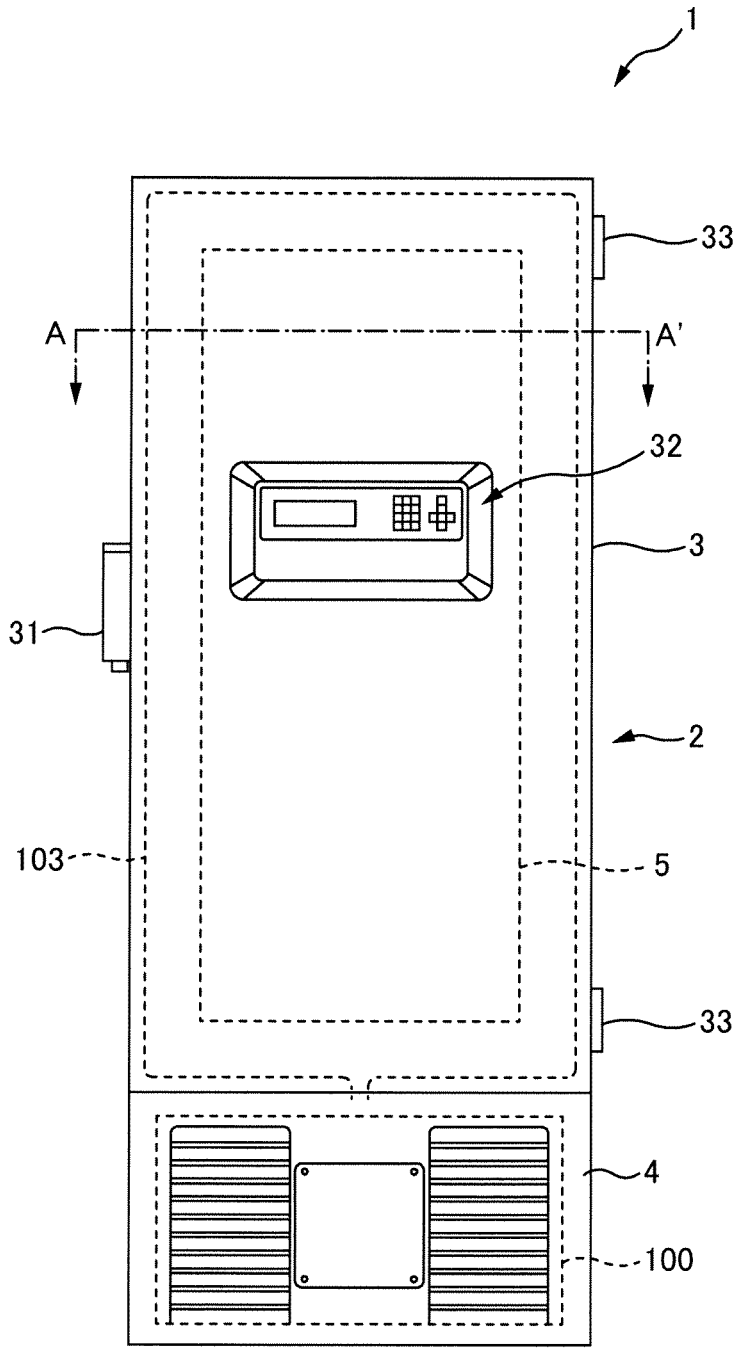
FIG. 1 is a front view of an example of a refrigerating apparatus of a first embodiment.
Figure 2:
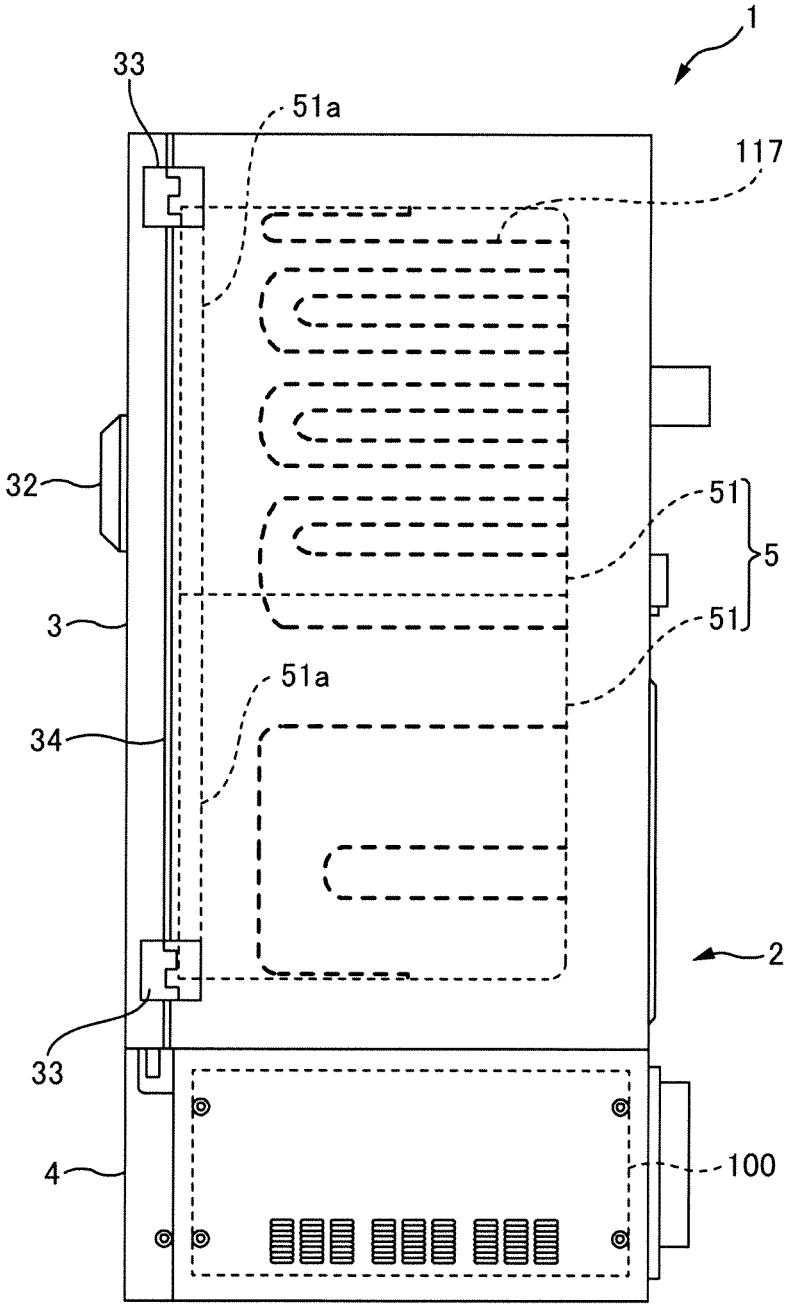
FIG. 2 is a side view of the refrigerating apparatus of FIG. 1.
Figure 3:
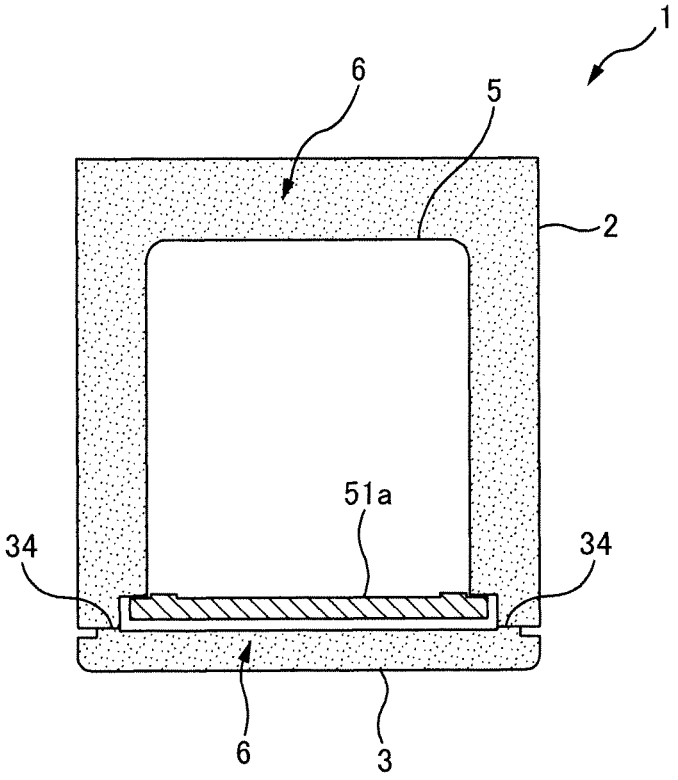
FIG. 3 is a sectional view taken along A-A' in the refrigerating apparatus of FIG. 1.
Figure 4:
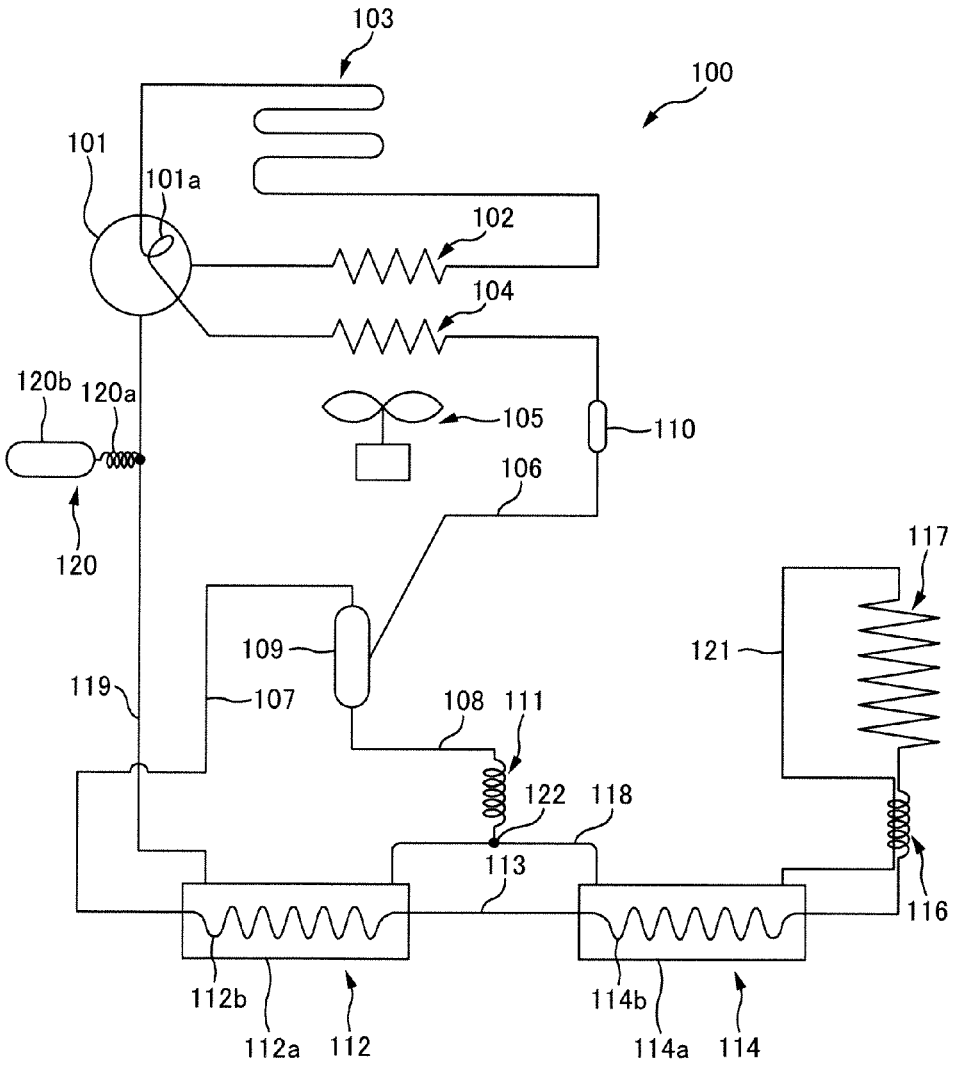
FIG. 4 is a circuit diagram of the example of the refrigerant circuit of the first embodiment.

Referring to FIGS. 1 to 4, a configuration example of the refrigerating apparatus 1 of a first embodiment will be described. FIG. 1 is a front view of an example of a refrigerating apparatus 1 of the first embodiment. FIG. 2 is a side view of the refrigerating apparatus 1 of FIG. 1. FIG. 3 is a sectional view taken along A-A' in the refrigerating apparatus of FIG. 1. FIG. 4 is a circuit diagram of the example of a refrigerant circuit 100 of the first embodiment.

<Refrigerating Apparatus>

As exemplified in FIGS. 1 to 3, the refrigerating apparatus 1 of this embodiment is provided with the refrigerant circuit 100. In the exemplification in the figure, except for an evaporator 117, which will be described later, the refrigerant circuit 100 is mostly housed in a machine chamber 4 in an outer box (housing) 2.

The outer box 2 is a substantially rectangular parallelepiped box made of steel plate, for example, and houses the machine chamber 4 and an inner box 5 including two storage chambers 51, for example, for storing frozen-stored articles such as frozen articles, biological tissues and the like. Also, at a front opening of the outer box 2, an outer door 3 for taking storage articles in/out the storage chamber 51 is provided in such a manner that it is capable of being opened/closed through a hinge 33.

The inner box 5 is a substantially rectangular parallelepiped box made of a steel plate, for example, and divided into two storage chambers 51. Two inner doors 51*a* made of a synthetic resin or the like are provided at the respective front openings of the two storage chambers 51 so as to be capable of being opened/closed through a predetermined hinge (not shown). Also, on an outer face except the front opening of this inner box 5, the evaporator 117, which will be described later, is provided.

The outer door 3 is obtained by processing a steel plate into a substantially plate shape, for example, and is provided with a handle 31 for an opening/closing operation by a user and a packing 34 for ensuring air-tightness in the outer box 2 when the front opening of the outer box 2 is closed. Here, the handle 31 is provided with a predetermined lock mechanism (not shown) configured to fix a state at which the outer door 3 closes the front opening of the outer box 2 and to release the fixation. On the front of the outer door 3, an operation panel 32 having a keyboard for a user to set a temperature in the inner box 5, a liquid crystal display configured to display a current temperature in the inner box 5 and the like is provided. This operation panel 32 is electrically connected, through a predetermined wiring (not shown), to a predetermined control portion (not shown) configured to control a compressor 101, which will be described later, a predetermined temperature sensor (not shown) provided in the storage chamber 51 and the like in a centralized manner.

In this embodiment, in order to improve cooling efficiency of the inner box 5, as shown in FIG. 3, an outer face of the inner box 5 and an inner face of the outer box 2 are separated by a predetermined distance, and an insulation material 6 is filled in the gap. This insulation material 6 is, for example, a polyurethane resin insulation material, a vacuum insulation material made of glass wool and the like. Also, as exemplified in FIG. 3, the insulation material 6 is also filled inside the outer door 3, providing insulation between the inner door 51*a* and the outer door 3. Moreover, as exemplified in FIGS. 1 and 2, the inner box 5 and the machine chamber 4 are also separated by a predetermined distance so that the insulation similar to the above is realized.

<Refrigerant Circuit>

As exemplified in FIG. 4, the refrigerant circuit 100 is provided with the compressor 101, a pre-condenser (condenser) 102 and a condenser (condenser) 104, a flow divider 109, a first decompressor 111 and a first heat exchanger 112, a second heat exchanger 114, a second decompressor 116, and the evaporator 117, and nonazeotropic refrigerant mixture having first to third refrigerants in its composition, which will be described later, is sealed therein. Here, in the vicinity of the pre-condenser 102 and the condenser 104, a common fan 105 is provided in arrangement so that air can be blown at the same time to the pre-condenser 102 and the condenser 104.

This refrigerant circuit 100 is also provided with an oil cooler 101*a* in contact with an oil reservoir in the compressor 101, a dehydrator 110 between the condenser 104 and the flow divider 109, and a buffer 120 between a sucking side of the compressor 101 and the first heat exchanger 112.

Moreover, the refrigerant circuit 100 is provided with a piping 103, a piping 106, a piping 107, a piping 108, a piping 113, a piping 118, a piping 119, and a piping 121 as follows. That is, the piping 103 connects the pre-condenser 102 and the oil cooler 101*a*. The piping 106 connects the condenser 104 and the flow divider 109. The piping 107 connects the flow divider 109 and an inner pipe 112*b* of the first heat exchanger 112. The piping 108 connects the flow divider 109 and the piping 118 connecting an outer pipe 112*a* of the first heat exchanger 112 and an outer pipe 114*a* of the second heat exchanger 114 through the first decompressor 111. The piping 113 connects the inner pipe 112*b* (first flow passage) of the first heat exchanger 112 and an inner pipe 114*b* (first flow passage) of the second heat exchanger 114. The piping 118 connects the other port of the outer pipe 112*a* (second flow passage) of the first heat exchanger 112 and one of the ports of the outer pipe 114*a* (second flow passage) of the second heat exchanger 114. The piping 119 connects one of the ports of the outer pipe 112*a* of the first heat exchanger 112 and a sucking side of the compressor 101. The piping 121 connects an outlet of the evaporator 117 and the other port of the outer pipe 114*a* of the second heat exchanger 114. The pipings 103, 106 to 108, 113, 118, 119, and 121 are exemplified for convenience of explanation of an operation of the refrigerant circuit 100, which will be described later, and the refrigerant circuit 100 is provided with other necessary pipings as appropriate.

The compressor 101 compresses a mixed refrigerant (first to third refrigerants) sucked at the sucking side from the outer pipe 112*a* of the first heat exchanger 112 and discharges the compressed refrigerant to the pre-condenser 102 at the discharge side. The compressor 101 has oil therein for improving air-tightness and ensuring lubrication of a mechanical portion and the oil cooler 101*a* configured to cool the oil.

The pre-condenser 102 includes, for example, a copper or aluminum pipe configured to cool the refrigerant (first to third refrigerants) discharged from the compressor 101.

The condenser 104 includes, for example, a copper or aluminum pipe configured to further cool the refrigerant (first to third refrigerants) discharged from the pre-condenser 102. Here, only the first refrigerant with a high evaporation temperature is condensed and liquefied. The first refrigerant is a refrigerant sufficiently cooled and condensed by air blown by the common fan 105.

The flow divider 109 divides the refrigerant (first to third refrigerants) outputted from the condenser 104 into a refrigerant in a liquid state (first refrigerant) and a refrigerant in a gas state (second and third refrigerants), outputs the liquid-state refrigerant to the first decompressor 111 and outputs the gas-state refrigerant to the inner pipe 112*b* of the first heat exchanger 112.

The first decompressor 111 is, for example, a capillary tube configured to decompress the liquid refrigerant (first refrigerant liquefied by the condenser 104) from the flow divider 109 and outputs it to an intermediate port 122 of the piping 118 connecting the outer pipe 112*a* of the first heat exchanger 112 and the outer pipe 114*a* of the second heat exchanger 114.

The first heat exchanger 112 is a double pipe made of, for example, copper or aluminum, including the outer pipe 112*a* and the inner pipe 112*b* and performs heat exchange between the refrigerants flowing through each of them.

The second heat exchanger 114 is a double pipe made of, for example, copper or aluminum, including the outer pipe 114*a* and the inner pipe 114*b* and performs heat exchange between the refrigerants flowing through each of them.

The second decompressor 116 is, for example, a capillary tube configured to decompress the refrigerant from the inner pipe 114*b* of the second heat exchanger 114 and to output it to the evaporator 117. In the embodiment, the capillary tube is wound around the piping 121 and an aluminum tape is wrapped thereon and it is configured in such a manner that heat exchanging is also performed here.

The evaporator 117 is, for example, a pipe made of copper or aluminum configured to evaporate the refrigerant decompressed by the second decompressor 116, and as exemplified in FIG. 2, the evaporator is provided so as to be brought into thermal contact with the outer face of the inner box 5 except the front opening.

The common fan 105 blows air to the pre-condenser 102 and the condenser 104 so as to promote radiation and condensation of the refrigerant (first to third refrigerants). The dehydrator 110 removes moisture contained in the refrigerant (first refrigerant and second as well as third refrigerants). The buffer 120 has a capillary tube 120*a* and an expansion tank 120*b* and suppresses unnecessary rise of a pressure on a low-pressure side in the refrigerating cycle by storing the gas-state refrigerant (first to third refrigerants) in the piping 119 in the expansion tank 120*b* through the capillary tube 120*a*.

The refrigerant of the present embodiment is a nonazeotropic refrigerant mixture having three types of refrigerants, namely, a first refrigerant, a second refrigerant, and a third refrigerant; the first refrigerant is, for example, R245fa and R600; the second refrigerant is, for example, R23; and the third refrigerant is, for example, R14.

Here, R245fa means pentafluoropropane ($CHF_2CH_2CF_3$) and its boiling point is +15.3° C. R600 means normal butane (n-$C_4H_{10}$) and its boiling point is −0.5° C. R23 means trifluoromethane ($CHF_3$) and its boiling point is −82.1° C. R14 means tetrafluoromethane ($CF_4$) and its boiling point is −127.9° C. R600 has an effect of recovering oil, water and the like in the refrigerant circuit. The water is a portion that could not be fully removed by the above-mentioned dehydrator 110. R245fa is a refrigerant to be mixed with flammable R600 with a predetermined ratio (R245fa and R600 in 7:3, for example) to be made inflammable.

—Operation of the Refrigerating Apparatus—

Figure 5:
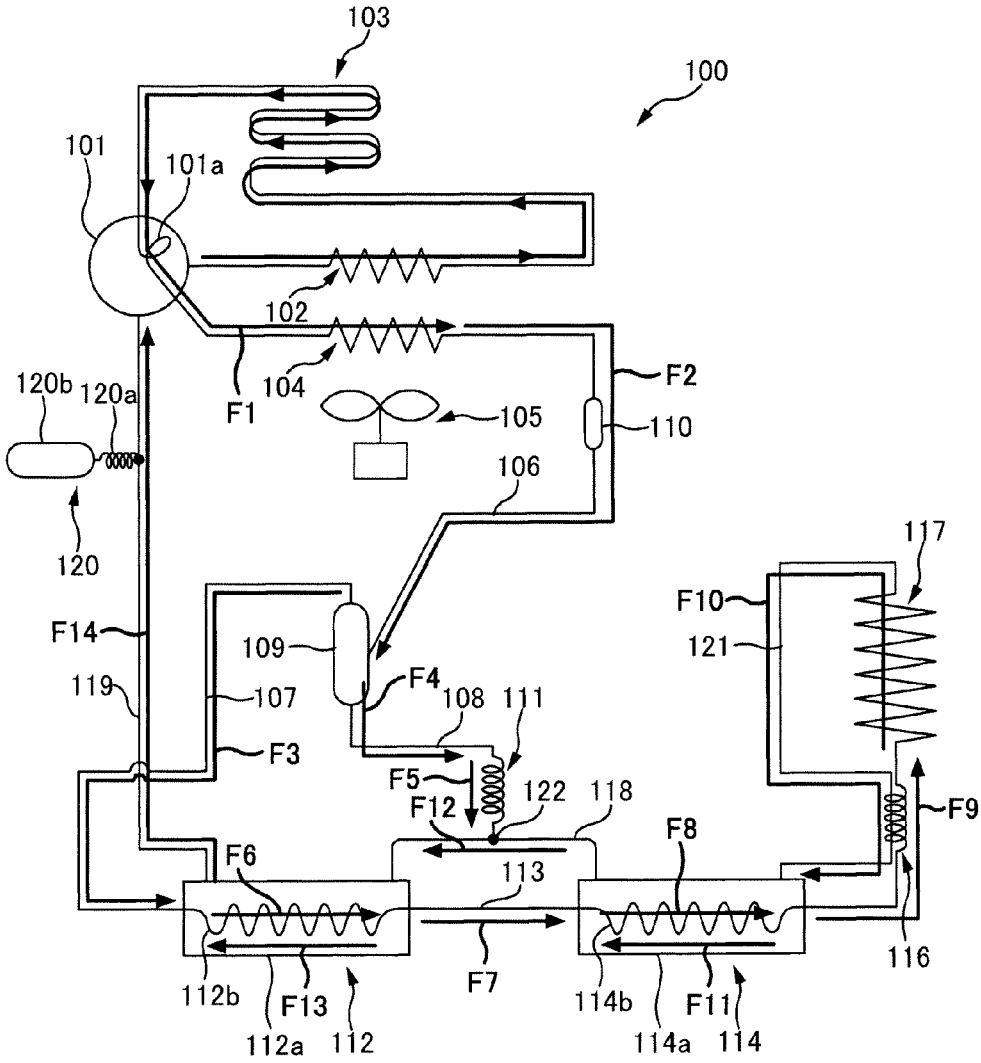
FIG. 5 is a schematic diagram illustrating flow passages F1 to F14 of nonazeotropic refrigerant mixture in the refrigerant circuit of FIG. 4.

Referring to FIG. 5, an operation example of the refrigerant circuit 100 in the refrigerating apparatus 1 provided with the above configuration will be described. The figure is a schematic diagram illustrating flow passages F1 to F14 of the nonazeotropic refrigerant mixture in the refrigerant circuit 100 of FIG. 4.

The first to third refrigerants which had been compressed and discharged by the compressor 101 and had been brought to a high temperature and a high pressure are cooled and brought to a low temperature by air blown by the fan 105 in the pre-condenser 102, pass through the piping 103, reach the oil cooler 101*a* in the compressor 101, cool the oil, and then, further cooled in the condenser 104 by being cooled by the air blown by the fan 105 (flow passage F1). The piping 103 of the present embodiment is a frame pipe provided on the inner side of a periphery portion of the front opening in the outer box 2 as exemplified in FIG. 1. Since this periphery portion of the front opening is a portion with which the packing 34 is in close contact in a state where the above-mentioned outer door 3 is closed, adhesion of frost due to cooling from the low-temperature inner box 5 side is prevented by heating it by the first to third refrigerants in the piping 103. As a result, close contact of the packing 34 is maintained, and air-tightness inside the outer box 2 is improved.

The first refrigerant with the boiling points of approximately 15° C. and 0° C. is liquefied by being cooled in the flow passage F1 and passes through the piping 106 in the liquid state. The second refrigerant with the boiling point of approximately −82° C. and the third refrigerant with the boiling point of approximately −128° C. pass through the piping 106 (flow passage F2) in the gas state. That is, the inside of the flow passage F2 is in the gas-liquid mixed state.

When the first to third refrigerants in the gas-liquid mixed state in the flow passage F2 are divided into gas and liquid by the flow divider 109, the second and third refrigerants in the gas state pass through the piping 107 (flow passage F3), while the first refrigerant in the liquid state enters the piping 108 (flow passage F4).

The first refrigerant is decompressed by the first decompressor 111 and outputted to the intermediate port 122 of the piping 118 connecting the outer pipe 112*a* of the first heat exchanger 112 and the outer pipe 114*a* of the second heat exchanger 114 (flow passage F5).

The first refrigerant decompressed in the flow passage F5 flows into the outer pipe 112*a* of the first heat exchanger 112 (second flow passage) through the other port and evaporates toward one of the ports. This evaporated first refrigerant merges with the second and third refrigerants in the gas state, which are returns from the evaporator 117 (flow passage F12) and flows through the outer pipe 112*a* in a direction (one direction) toward the sucking side of the compressor 101 (flow passage F13).

On the other hand, between the second and third refrigerants in the gas state in the flow passage F3, the second refrigerant having a higher boiling point (approximately −82° C.) is cooled and liquefied by a heat absorption action of the first refrigerant evaporated in the outer pipe 112*a* of the first heat exchanger 112, while flowing through the flow passage F6 (that is, inside the inner pipe 112*b*), which is the first flow passage of the first heat exchanger 112, in a direction (direction opposite to the above-mentioned one direction) toward the second heat exchanger 114 side. The evaporation temperature of the first refrigerant at this time is provided as a temperature suitable for cooling/condensation of the second refrigerant. In this flow passage F6, the third refrigerant having a boiling point (approximately −128° C.) lower than that of the second refrigerant is not condensed since an evaporation temperature of the first refrigerant is high and remains in a substantially gas state.

The substantially liquid state second refrigerant and the substantially gas state third refrigerant pass through the piping 113 (flow passage F7) toward the inner pipe 114*b* of the second heat exchanger 114.

Between the substantially liquid state second refrigerant and the substantially gas state third refrigerant in the flow passage F7, the third refrigerant having a lower boiling point is cooled by the second and third refrigerants flowing through the flow passage F11 of the outer pipe 114*a* which had been evaporated by the evaporator 117 and had become low temperature/low pressure while flowing through the inner pipe 114*b* (first flow passage) of the second heat exchanger 114 in a direction (direction opposite to the above one direction) toward the evaporator 117 side (flow passage F8), and is brought into a substantially liquid state. At this time, a part of the third refrigerant not evaporated by the evaporator 117 is evaporated and cools the inner pipe 114*b* at a lower temperature.

The second and third refrigerants in a substantially liquid state which have passed through the inner pipe 114*b* pass the second decompressor 116 and are decompressed (flow passage F9). At this time, they are further cooled by exchanging heat with the second and third refrigerants flowing through the piping 121 that had been evaporated by the evaporator 117 to a low temperature/low pressure and after having been further liquefied, they are evaporated in the evaporator 117 and cool a cooling target including a refrigerated storage goods in the inner box 5 and its storage chamber 51. After that, they are outputted to the other port of the outer pipe 114*a* of the second heat exchanger 114 (flow passage F10).

With regard to the low-temperature/low-pressure second and third refrigerants that have flown into the outer pipe 114*a* (second flow passage) from the evaporator 117, a part thereof that could not be fully evaporated in the evaporator 117 is evaporated in the second flow passage and flows in one direction toward the first heat exchanger 112 (flow passage F11) while exchanging heat with the refrigerant flowing through the inner pipe 114*b* in the opposite direction and passes through the piping 118 through the one port of the outer pipe 114*a* of the second heat exchanger 114 (flow passage F12).

The second and third refrigerants in a gas state flow into the other port of the outer pipe 112*a* of the first heat exchanger 112 (second flow passage), merge with the first refrigerant decompressed in the above-mentioned flow passage F5 and brought into the gas state and form the above-mentioned flow passage F13, and after having cooled the second and third refrigerants in the above-mentioned flow passage F6, the first to third refrigerants in the gas state pass through the piping 119 toward the sucking side of the compressor 101 (flow passage F14).

As mentioned above, the refrigerant circuit 100 of the embodiment is configured such that the flow of the refrigerants returning to the compressor 101 through the evaporator 117 (flow in the one direction of the flow passages F11 and F13) and the flow of the refrigerant toward the evaporator 117 through the condenser 104 (flow in the opposite direction of the flow passages F6 and F8) are in the opposite direction to each other (countercurrent) in the heat exchanger.

Also, the second and third refrigerants flowing toward the evaporator 117 are made to sequentially flow from the first heat exchanger 112 with a higher temperature to the second heat exchanger 114 with a lower temperature. That is, it is so configured that, in the first heat exchanger 112, the second and third refrigerants flowing through the first flow passage in the opposite direction are cooled by an evaporation action of the first refrigerant and by the second and third refrigerants that have passed the second heat exchanger 114, and in the second heat exchanger 114, the second and third refrigerants flowing through the first flow passage are further cooled by the second and third refrigerants at the lowest temperature after having passed the evaporator 117. As a result, the second and third refrigerants are efficiently cooled in combination with the above-mentioned countercurrent so as to ensure condensation/liquefaction.

According to the operation of the above-described refrigerant circuit 100, by going through the liquefaction process in two stages, that is, the second refrigerant is substantially liquefied in the flow passage F6 of the first heat exchanger 112 and the third refrigerant is substantially liquefied in the flow passage F8 of the second heat exchanger 114, the liquefaction efficiency of the second and third refrigerants is improved, and thus, the evaporation temperature of the evaporator 117 can be maintained at a design temperature.

Also, by operating the above-mentioned refrigerant circuit 100 independently in two circuits in the single refrigerating apparatus 1, for example, an allowance can be given to the cooling capability of the refrigerating apparatus 1. As a specific configuration example, the double refrigerant circuits 100 (excluding the evaporator 117) are housed in the machine chamber 4, and the double evaporators 117 are provided on the outer face of the inner box 5 except the front opening. As a result, for example, even if one of the refrigerant circuits 100 fails, the in-storage temperature can be guaranteed to a predetermined temperature by operating the other refrigerant circuit 100.

The following has been confirmed experimentally. That is, by operating the double refrigerant circuits 100 in which nonazeotropic refrigerant mixture with approximately 52 to 68 weight % of R245fa and R600, approximately 19 to 37 weight % of R23, and approximately 8 to 15 weight % of R14 (the "weight %" is a mixing ratio against the total refrigerant amount) is sealed and cooling the storage chamber 51 having a volumetric capacity of approximately 400 to 500 liters, the temperature inside the storage chamber 51 was cooled to approximately −85° C. or lower while maintaining the pressure on the discharge side (high pressure side) of the compressor 101 at approximately 2 MPa or below.

Thus, as a mixing ratio of the nonazeotropic refrigerant mixture against the total refrigerant amount, it is, for example, preferable to set R245fa and R600 at approximately 52 to 68 weight, R23 at approximately 19 to 37 weight %, and R14 at approximately 8 to 15 weight %.

R23 is used as the second refrigerant, but it is not limited thereto, and R116 (hexafluoroethane: $CF_3CF_3$) with a boiling point of −78.4° C. or R508A obtained by mixing the aforementioned R23 and R116 with a predetermined ratio (R23/R116=39/61, boiling point: −85.7° C.) or R508B (R23/R116=46/54, boiling point: −86.9° C.) can exert the similar effect.

As described above, in the refrigerating apparatus of the present embodiment, a mixed refrigerant in which the first refrigerant with a relatively high evaporation temperature and the second and third refrigerants with evaporation temperatures lower than that are mixed is sealed, the second refrigerant is condensed by evaporating the first refrigerant condensed/liquefied by the condenser in the first heat exchanger and further performs heat exchange in the second heat exchanger with a return refrigerant evaporated by the evaporator and has become low temperature and low pressure. Thus, the third refrigerant can be surely condensed and liquefied so that the cooling efficiency can be improved while costs are suppressed.

It is only necessary that the refrigerating apparatus 1 of the present embodiment has at least the compressor 101, the condenser (for example, the pre-condenser 102, the condenser 104 and the like), the evaporator 117, the flow divider 109, the first heat exchanger 112, and the second heat exchanger 114 and is provided with the refrigerant circuit 100 in which the nonazeotropic refrigerant mixture having the first refrigerant as well as the second and third refrigerants with boiling points lower than the boiling point of the first refrigerant is sealed. Here, the compressor 101 compresses the first to third refrigerants flowing in the direction of the flow passage F14, the condenser cools the first to third refrigerants discharged from the compressor 101, the flow divider 109 divides the first to third refrigerants outputted from the condenser into the liquid state first refrigerant and the gas state second and third refrigerants, the first heat exchanger 112 performs heat exchange between the first refrigerant outputted from the flow divider 109 as well as the second and third refrigerants outputted from the heat exchanger 114 and the second and third refrigerants outputted from the flow divider 109, the second heat exchanger 114 performs heat exchange between the second and third refrigerants outputted from the first heat exchanger 112 and the second and third refrigerant outputted from the evaporator 117, and the evaporator 117 evaporates the second and third refrigerants outputted form the second heat exchanger 114 in the direction of the flow passage F7.

According to the refrigerating apparatus 1, in the first heat exchanger 112, the second and third refrigerants from the flow divider 109 can be cooled by the first refrigerant from the flow divider 109 and by the second and third refrigerants outputted from the second heat exchanger 114 in the direction of the flow passage F12. Also, in the second heat exchanger 114, the second and third refrigerants cooled by the first heat exchanger 112 can be further cooled by the second and third refrigerants from the evaporator 117. That is, in the second heat exchanger 114, in order to cool the second and third refrigerants from the flow divider 109 by the second and third refrigerants (including almost no first refrigerant) from the evaporator 117, by adding the second heat exchanger 114 to the first heat exchanger 112, the liquefaction efficiency of the second and third refrigerants in the gas state after flow division can be improved. Particularly, in a case where the boiling points of the second and third refrigerants are different, with one of the second and third refrigerants with a higher boiling point being substantially liquefied in the flow passage F6 of the first heat exchanger 112 and the other being substantially liquefied in the flow passage F8 of the second heat exchanger 114, the liquefaction efficiency of the second and third refrigerants can be further improved. As the amounts of the second and third refrigerants in the liquid state entering the evaporator 117 are increased by this improvement in the liquefaction efficiency, the heat absorption action of the evaporator 117 is improved.

Also, in the above-mentioned refrigerating apparatus 1, a part of the third refrigerant outputted from the evaporator 117 is evaporated in the second heat exchanger 114.

As a result, since the second heat exchanger 114 can cool the second and third refrigerants outputted from the first heat exchanger 112 at a lower temperature, liquefaction of the second and third refrigerants is further promoted.

Also, in the above-mentioned refrigerating apparatus 1, a decompressing device constituted by a capillary tube is provided in the piping extending from the second heat exchanger 114 to the evaporator 117 by winding it around the piping extending from the evaporator 117 to the second heat exchanger 114 so as to further perform heat exchange in the decompressing device.

As a result, the second and third refrigerants in the capillary tube are further cooled by exchanging heat with the second and third refrigerants evaporated in the evaporator 117 and brought to low temperature and low pressure, and liquefaction is further promoted.

Other Embodiments

The above embodiments of the present invention are simply for facilitating the understanding of the present invention and are not in any way to be construed as limiting the present invention. The present invention may variously be changed or altered without departing from its spirit and encompass equivalents thereof. The above-mentioned first heat exchanger 112 and the second heat exchanger 114 are of the double-tube type having the outer pipes 112*a* and 114*a*, and the inner pipes 112*b* and 114*b*, respectively, but not limited thereto, and a multi-tube type or plate-type may be used, for example.

With regard to the above-mentioned dehydrators 110 and 115, only one of them may be installed in the piping 106, for example.

Second Embodiment

Refrigerating Apparatus

In FIGS. 1 to 3, the refrigerating apparatus 1 shall be deemed to be replaced with a refrigerating apparatus 700, the refrigerant circuit 100 shall be deemed to be replaced with a refrigerant circuit 200, the piping 103 shall be deemed to be replaced with a frame pipe 500, and the evaporator 117 shall be deemed to be replaced with an evaporator 600. The other configurations of the refrigerating apparatus 700 in the second embodiment are the same as the configurations of the first embodiment.

—First Refrigerant Circuit and Second Refrigerant Circuit—

Figure 6:
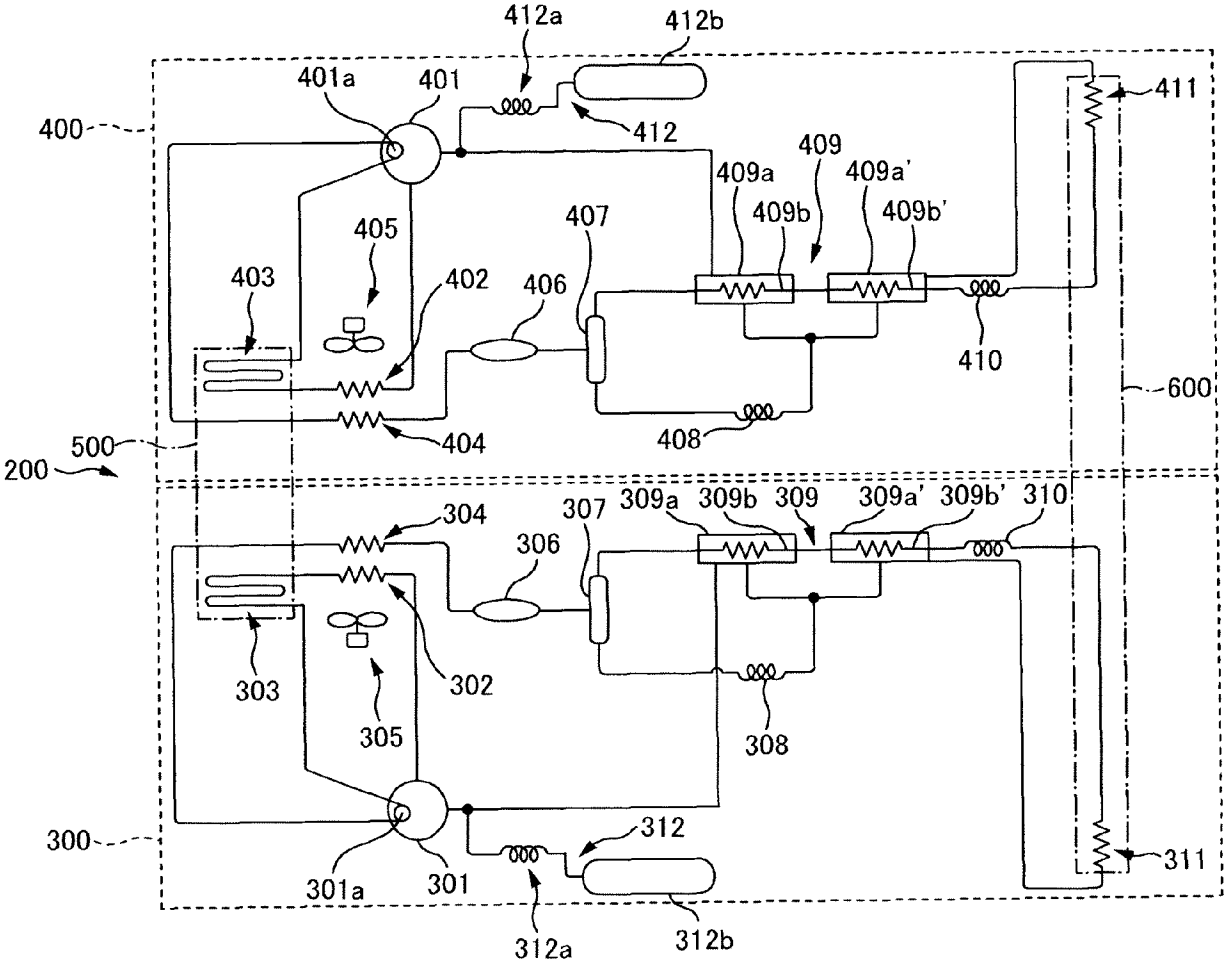
FIG. 6 is a circuit diagram of an example of a refrigerant circuit of a second embodiment.

Referring to FIG. 6, a configuration example of the refrigerant circuit 200 of the second embodiment will be described. This figure is a circuit diagram of an example of the refrigerant circuit 200 of the second embodiment.

As exemplified in this figure, the refrigerant circuit 200 has substantially the same two refrigerant circuits (the respective refrigerant circuits are substantially the same circuits as the refrigerant circuit in FIG. 4), that is, a first refrigerant circuit 300 and a second refrigerant circuit 400.

In the first refrigerant circuit 300 and the second refrigerant circuit 400, a first compressor 301 and a second compressor 401 correspond to the compressor 101 in FIG. 4, pre-condensers 302 and 402 correspond to the pre-condenser 102 in FIG. 4, condensers 304 and 404 correspond to the condenser 104 in FIG. 4, flow dividers 307 and 407 for dividing a flow into a gas and a liquid correspond to the flow divider 109 in FIG. 4, decompressors 308 and 408 correspond to the first decompressor 111 in FIG. 4, a heat exchanger 309 corresponds to the first heat exchanger 112 and the second heat exchanger 114 in FIG. 4, a heat exchanger 409 similarly corresponds to the first heat exchanger 112 and the second heat exchanger 114 in FIG. 4, decompressor 310 and 410 correspond to the second decompressor 116 in FIG. 4, and a first evaporation pipe 311 and a second evaporation pipe 411 correspond to the evaporator 117 in FIG. 4.

—First Evaporation Pipe and Second Evaporation Pipe—

Figure 7:
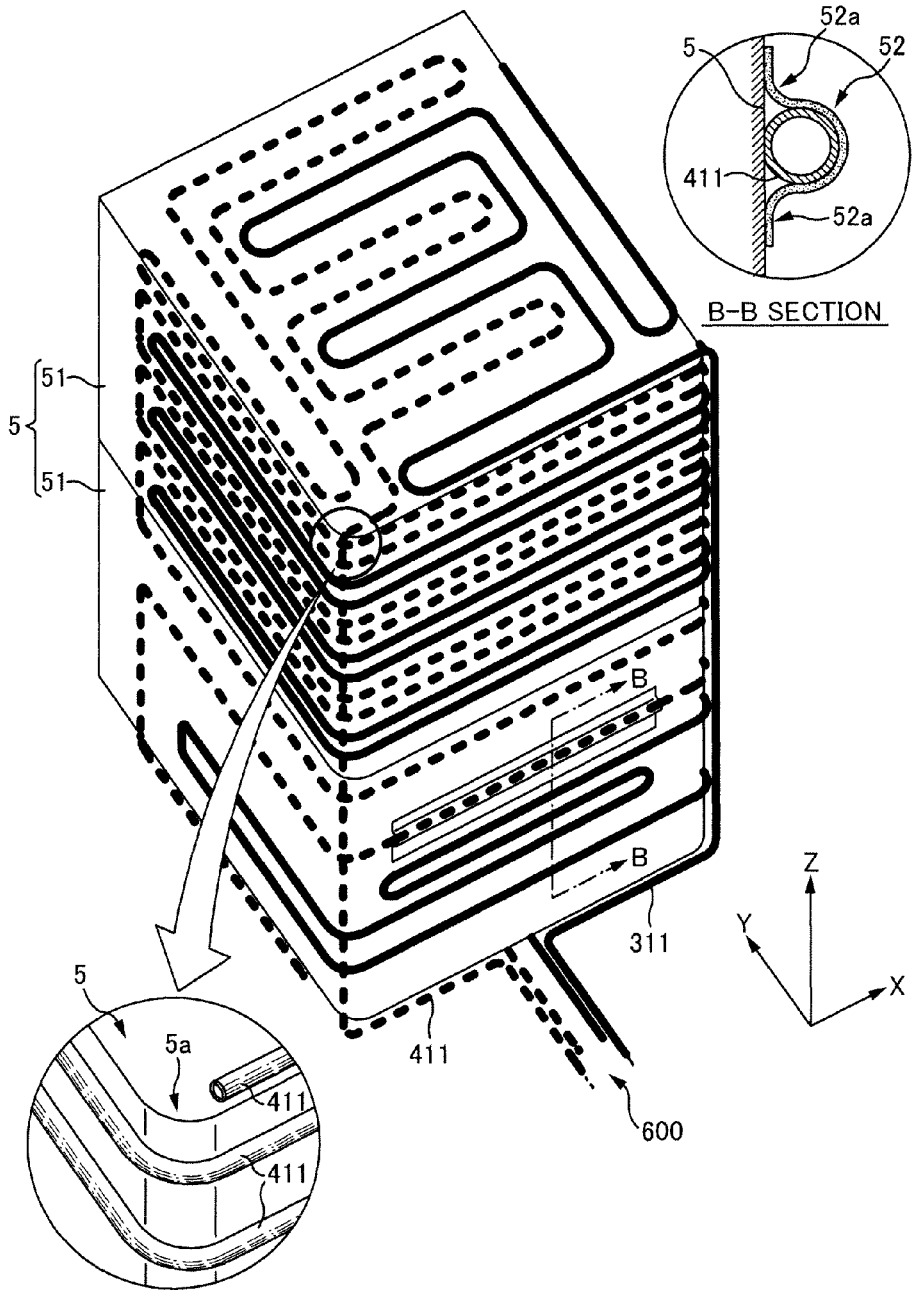
FIG. 7 is a perspective view of an example of an inner box of the second embodiment and a first evaporation pipe and a second evaporation pipe attached to an outside thereof.
Figure 8:
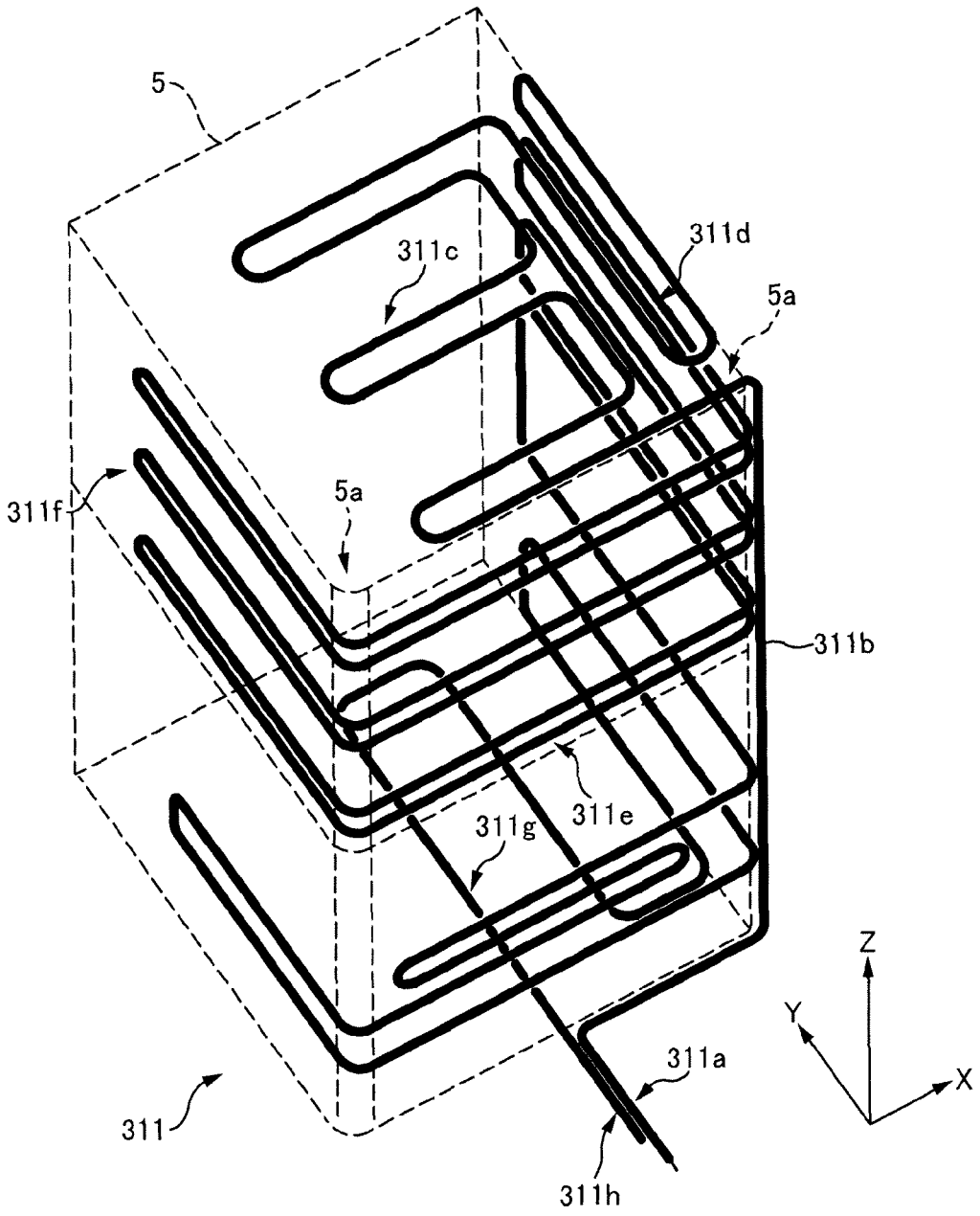
FIG. 8 is a perspective view of the first evaporation pipe of FIG. 7.
Figure 9:
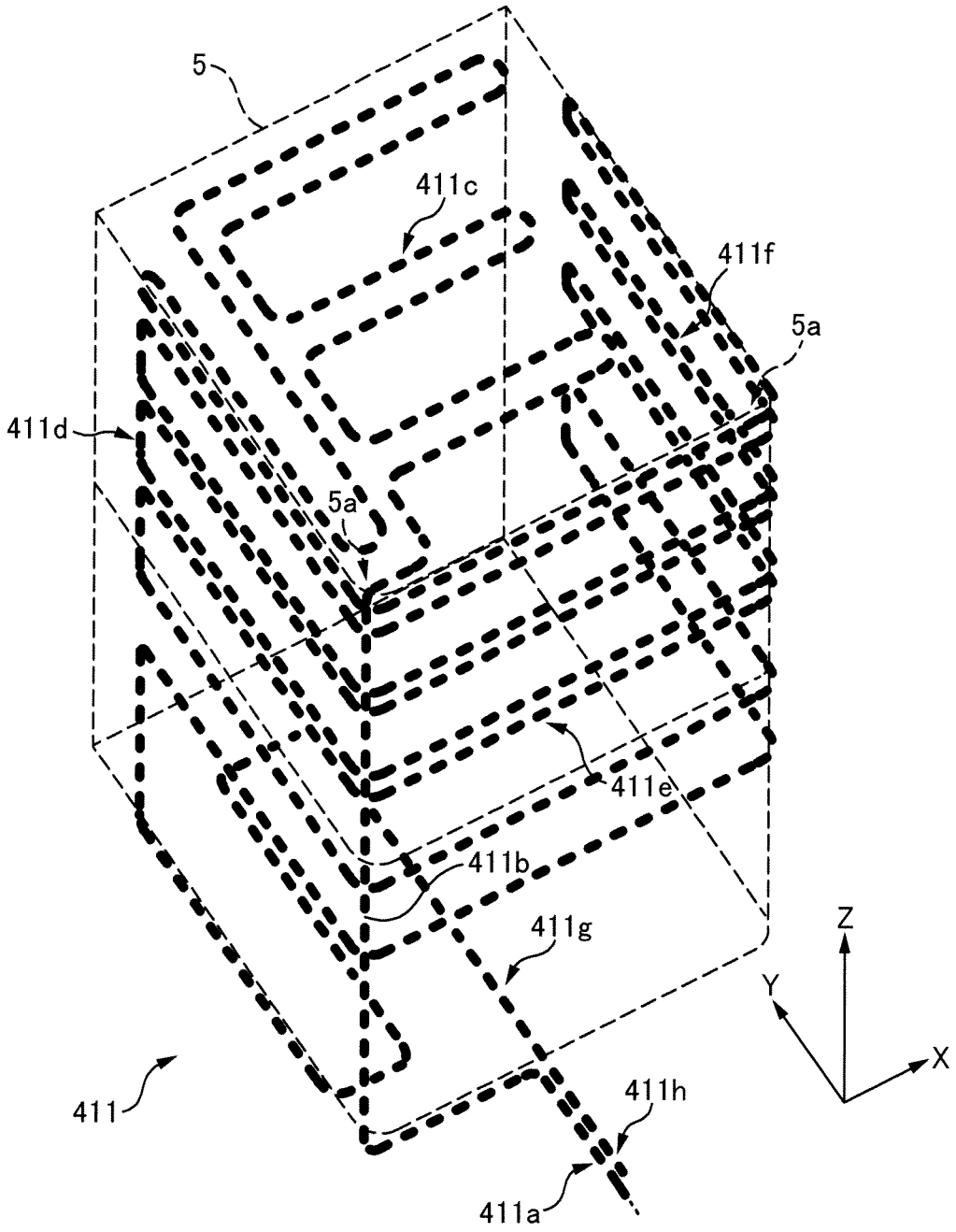
FIG. 9 is a perspective view of the second evaporation pipe of FIG. 7.

Referring to FIGS. 7 to 9, a configuration example of the evaporator 600 (the first evaporator pipe 311 and the second evaporator pipe 411) of this embodiment will be described. FIG. 7 is a perspective view of an example of the inner box 5 as well as the first evaporation pipe 311 and the second evaporation pipe 411 attached to an outside thereof according to the second embodiment. FIG. 8 is a perspective view of the first evaporation pipe 311 of FIG. 7. FIG. 9 is a perspective view of the second evaporation pipe 411 of FIG. 7.

The first evaporation pipe 311 is a single continuous pipe, but in FIG. 8, at a portion where the pipe at the front on a line of sight crosses the pipe at the back on the line of sight, the pipe at the back is shown as if it is cut midway for ease to be seen as a perspective view. Also, the second evaporation pipe 411 is a single continuous pipe, but it is shown by a dotted line for convenience in order to be distinguished from a solid line indicating the first evaporation pipe 311 in FIGS. 7 and 9. Moreover, in FIGS. 8 and 9, the inner box 5 to which the first evaporation pipe 311 and the second evaporation pipe 411 are attached is shown by a dotted line for ease to be seen as a perspective view.

As exemplified in FIG. 7, the inner box 5 includes a top plate (+Z side plate), a back plate (−Y side plate), both side plates (±X side plates) and a bottom plate (−Z side plate), and a boundary portion 5*a* between the both side plates and the back plate is formed by a curved face forming an arc-shaped profile when seen from the upper side (+Z side). As exemplified in an inserted drawing at a lower part in the figure, the curved face of the boundary portion 5*a* is formed in such a manner that its radius of curvature is equal to the radius of curvature of the second evaporation pipe 411. This also applies to the first evaporation pipe 311. With this configuration, both the first evaporation pipe 311 and the second evaporation pipe 411 are brought into thermal contact with the boundary portion 5*a* between the both side plates and the back plate of the inner box 5. That is, since the single pieces of the first evaporation pipe 311 and the second evaporation pipe 411 can be bent while they are in thermal contact with the boundary portion 5*a* and while maintaining a constant conductance, processes such as welding, complicated bending and the like can be dispensed with while improving uniformity of a temperature distribution inside the inner box 5

(inside the storage). Particularly, the latter facilitates attachment of the evaporator 600 to the inner box 5.

Hereinafter, for convenience, the outer side of the top plate of the inner box 5 is referred to as "top face", the outer side of the back plate of the inner box 5 as "back face", the outer side of the side plate of the inner box 5 as "side face", and the outer side of the bottom plate of the inner box 5 as "bottom face".

As exemplified in FIG. 8, the first evaporation pipe 311 is configured as a pipe in which portions 311*a* to 311*h* are integrated.

The first evaporation pipe 311 forms the portion 311*a* through which a refrigerant flows from the heat exchanger 309 through the decompressor 310 to the boundary portion between the back face and the bottom face of the inner box 5, and the portion 311*b* through which a refrigerant flows from a lower side to an upper side in parallel with the boundary portion 5*a* between one side face (+X side face) and the back face of the inner box 5. The portion 311*b* forming a linear shape in the vertical direction is arranged outside a bent portion between the portion 311*d* and the portion 311*e*, which will be described later.

The first evaporation pipe 311 continuing from the portion 311*b*, as it goes from the upstream side to the downstream side of the flow of the refrigerant, meanders from the back face side (−Y side) to the front side (+Y side) across a width in the right and left direction (±X side) of the top face of the inner box 5 and then, back and forth across a width in the front and rear direction (±Y side) of the top face so as to form the portion 311*c* attached to the top face.

The first evaporation pipe 311 continuing from the portion 311*c* forms portions 311*d*, 311*e*, and 311*f* which meander, as it goes from the upstream side to the downstream side of the flow of the refrigerant, across a width extending through the both side faces and the back face of the inner box 5 from the upper side to the lower side and which are attached to the both side faces and the back face. The portion 311*d* is a portion of the first evaporation pipe 311 attached to one side face of the inner box 5, the portion 311*e* is a portion of the first evaporation pipe 311 attached to the back face of the inner box 5, and the portion 311*f* is a portion of the first evaporation pipe 311 attached to the other side face of the inner box 5.

The first evaporation pipe 311 continuing from the portion 311*d* forms the portion 311*g* which meanders, as it goes from the upstream side to the downstream side of the flow of the refrigerant, across a width in the front and rear direction of the bottom face of the inner box 5 from the one side-face side to the other side-face side and which are attached to the bottom face, and the portion 311*h* through which the refrigerant flows from the boundary portion between the back face and the bottom face of the inner box 5 to the heat exchanger 309.

As exemplified in FIG. 9, the second evaporation pipe 411 is constituted as an integral pipe of portions 411*a* to 411*h*.

The second evaporation pipe 411 forms the portion 411*a* through which the refrigerant flows from the heat exchanger 409 to the boundary portion between the back face and the bottom face of the inner box 5 via the decompressor 410, and the portion 411*b* through which the refrigerant flows from the lower side to the upper side in parallel with the boundary portion 5*a* between the other side face (−X side face) and the back face of the inner box 5. The portion 411*b* forming a linear shape in the vertical direction is arranged outside the bent portion between the portion 411*d* and the portion 411*e*, which will be described later.

The second evaporation pipe 411 continuing from the portion 411*b* meanders, as it goes from the upstream side to the downstream side of the flow of the refrigerant, across a width in the right and left direction (±X side) of the top face of the inner box 5 from the back face side (−Y side) to the front side (+Y side) and then, back and forth in the front and rear direction (±Y side) across a width on the top face so as to form the portion 411*c* attached to the top face.

The second evaporation pipe 411 continuing from the portion 411*c* forms portions 411*d*, 411*e*, and 411*f* which meander, as it goes from the upstream side to the downstream side of the flow of the refrigerant, across a width extending through the both side faces and the back face of the inner box 5 from the upper side to the lower side and which are attached to the both side faces and the back face. The portion 411*d* is a portion attached to one side face of the inner box 5 in the second evaporation pipe 411, the portion 411*e* is a portion attached to the back face of the inner box 5 in the second evaporation pipe 411, and the portion 411*f* is a portion attached to the other side face of the inner box 5 in the second evaporation pipe 411.

The second evaporation pipe 411 continuing from the portion 411*d* forms the portion 411*g* which meanders, as it goes from the upstream side to the downstream side of the flow of the refrigerant, across a width in the front and rear direction of the bottom face of the inner box 5 from the one side-face side to the other side-face side, and the portion 411*h* through which the refrigerant flows from the boundary portion between the back face and the bottom face of the inner box 5 to the heat exchanger 409.

As mentioned above, a region occupied by the first evaporation pipe 311 (FIG. 8) and a region occupied by the second evaporation pipe 411 (FIG. 9) are distributed substantially equally without overlapping each other on the whole face except the front opening of the inner box 5. Thus, when the first refrigerant circuit 300 and the second refrigerant circuit 400 are operated together, uniformity of the temperature distribution in the storage is improved. Also, in a case where one of the first refrigerant circuit 300 and the second refrigerant circuit 400 fails and only the other is operated, predetermined cooling capability and uniform temperature distribution in the storage can be achieved substantially regardless of which of the refrigerant circuits 300 and 400 fails.

Returning to FIG. 7, the above-mentioned first evaporation pipe 311 and the above-mentioned second evaporation pipe 411 alternately meander in each of the top face, back face, both side faces, and bottom face of the inner box 5. For example, on the top face of the inner box 5, the first evaporation pipe 311 and the second evaporation pipe 411 are alternately arranged substantially every two pipes when seen in the front-rear direction (Y-axis direction) (FIG. 7). On the both side faces and the back face of the inner box 5, the first evaporation pipe 311 and the second evaporation pipe 411 are alternately arranged substantially every two pipes when seen in the vertical direction (Z-axis direction) (FIG. 7). However, on the bottom face, the first evaporation pipe 311 is arranged on one side in the right and left direction (X-axis direction), while the second evaporation pipe 411 is arranged on the other side in the right and left direction (FIGS. 8 and 9). Since the first evaporation pipe 311 and the second evaporation pipe 411 are brought into thermal contact with the whole face of each face substantially uniformly, uniformity of the temperature distribution in the storage is further improved.

Moreover, as exemplified in an inserted drawing on an upper side in FIG. 7, the second evaporation pipe 411 is attached to the back face of the inner box 5 with an aluminum tape 52. The same applies to the first evaporation pipe 311. Here, the aluminum tape 52 is, for example, a sheet material in a band shape made of aluminum in which an adhesive having thermal conductivity is applied on one side. In this embodiment, the first evaporation pipe 311 and the second evaporation pipe 411 are attached to each face except the front opening of the inner box 5 with the aluminum tape 52 in such a manner that the pipes 311 and 411 are covered. However, in FIG. 7, only a part of the aluminum tape 52 is exemplified for convenience of illustration. As exemplified in the inserted drawing on the upper side in FIG. 7, the second evaporation pipe 411 is only in a thermal line contact with the outer face of the inner box 5, but the outer face of the second evaporation pipe 411 and the outer face of the inner box 5 can be brought into a thermal plane contact with each other through both end portions 52*a* in a width direction of the aluminum tape 52 with higher thermal conductivity than stainless or the like. The same applies to the first evaporation pipe 311. As a result, cooling capability and uniformity of temperature distribution in the storage of the refrigerating apparatus 700 are further improved. As mentioned above, since the insulation material 6 made of a polyurethane resin insulation material or the like is filled in the gap between the inner box 5 on which the first evaporation pipe 311 and the second evaporation pipe 411 are attached to the outer face thereof and the outer box 2, the pipes 311 and 411 are reliably attached to the outer face of the inner box 5 by a pressure of the insulation material 6.

Moreover, as exemplified in FIG. 7, the aluminum tape 52 is attached with its longitudinal direction lying along the longitudinal direction of the second evaporation pipe 411. The same applies to the first evaporation pipe 311. As a result, since the first evaporation pipe 311 and the second evaporation pipe 411 can be, for example, covered one by one with the aluminum tape 52 with an appropriate length at each portion forming a linear shape, an attachment work of the evaporator 600 to the refrigerating apparatus 700 is facilitated. Also, by this way of attaching, a space formed by the inner face of the both end portions 52*a* of the aluminum tape 52, the outer faces of the pipes 311 and 411, and the outer face of the inner box 5 is reduced (see the inserted drawing on the upper side in FIG. 7) and heat conductivity between the pipes 311, 411 and the outer face of the inner box 5 can be improved. As a result, a manufacturing cost of the refrigerating apparatus 700 can be suppressed while its cooling capability and uniformity of temperature distribution in the storage can be further improved.

Other Embodiments

The above embodiments of the present invention are simply for facilitating the understanding of the present invention and are not in any way to be construed as limiting the present invention. The present invention may variously be changed or altered without departing from its spirit and encompass equivalents thereof.

In the above-mentioned embodiment, only the boundary portion 5*a* between the both side plates and the back plate of the inner box 5 (see the inserted drawing on the lower side in FIG. 7) is formed by a curved face, but it is not limited thereto. For example, in addition to the boundary portion 5*a*, a boundary portion between the top plate and the side plate, a boundary portion between the top plate and the back plate, a boundary portion between the bottom plate and the side plate, a boundary portion between the bottom plate and the back plate and the like of the inner box 5 may form a curved face. Since these boundary portions are formed by curved faces, the single pieces of the first evaporation pipe 311 and the second evaporation pipe 411 can be bent in thermal contact with the portions while maintaining a constant conductance.

In the above-mentioned embodiment, the boundary portion 5*a* is formed by a curved face having an arc-shaped profile when seen from the upper side (+Z side), but it is not limited thereto. For example, it may appear to form an arc shape as a whole while its detail may technically form a polygonal shape. In short, the shape of the boundary portion 5*a* may be any shape as long as a thermal contact area of the portion where the first evaporation pipe 311 or the second evaporation pipe 411 are bent is larger than the case of bending at a right angle.

In the above-mentioned embodiment, in the top face, both side faces, and back face of the inner box 5, the first evaporation pipe 311 and the second evaporation pipe 411 are alternately arranged substantially every two pipes (see FIG. 7), but it is not limited thereto. The two pipes 311 and 411 may be alternately arranged by every even number of pipes no fewer than four. In short, it is only necessary that the first evaporation pipe 311 and the second evaporation pipe 411 alternately meander on the top face, both side faces, and back face.

In the above-mentioned embodiment, the band-shaped aluminum tape 52 is attached to the first evaporation pipe 311 and the second evaporation pipe 411 so as to lie along the respective longitudinal directions (see FIG. 7), but it is not limited thereto. For example, a sheet of a relatively large rectangular aluminum tape may be used to cover the entire meandering portions of the pipes 311 and 411, for example. As a result, since overlap between tape pieces which could be generated when a plurality of band-shaped aluminum tape pieces is used can be omitted, an amount of usage of the aluminum tape can be reduced.

In the above-mentioned embodiment, the refrigerant sealed in the first refrigerant circuit 300 is the same as the refrigerant sealed in the second refrigerant circuit 400, but it is not limited thereto, and, for example, refrigerants different from each other may be sealed.

Third Embodiment

A low-temperature storage for storing a storage target such as a refrigerated articles, provided with a vacuum insulation panel and a foam insulation material inside an insulation door so as to improve insulation in the storage is known. Specifically, two sheets of the vacuum insulation panel with substantially the same size are attached to an upper side and a lower side on an inner face of an outer plate of the insulation door. Also, the foam insulation material is filled in a portion between the outer plate and the inner plate of the insulation door except the vacuum insulation panel (Japanese Patent Laid-Open No. H10-300330).

If air is cooled, a density of the air is naturally raised. Thus, in the low-temperature storage, a temperature of the air at a lower side can be lower than a temperature of the air at an upper side. In the case of the above low-temperature storage, since the substantially same vacuum insulation panels are attached to the upper side and the lower side of the insulation door, an insulation effect of the lower side in the insulation door for the storage might be insufficient as compared with the insulation effect of the upper side in the insulation door for the storage.

Also, the inside of the low-temperature storage is cooled by a refrigerating apparatus. A cooling temperature in the storage by the refrigerating apparatus is adjusted through an operation of a control panel provided in the low-temperature storage. The control panel needs to ensure favorable operability and is preferably provided on a front of the low-temperature storage. Accordingly, consider a case in which the control panel is provided on the outer plate of the above-mentioned insulation door. In this case, a wiring for electrically connecting the control panel to the refrigerating apparatus needs to go through the inside of the insulation door, and moreover, the insulation effect of the vacuum insulation panel needs to be prevented from being lowered. Therefore, the control panel is attached substantially at the center in the vertical direction of the insulation door avoiding the vacuum insulation panel, which is problematic in operability.

Thus, a refrigerating apparatus according to this embodiment has an object to improve insulation efficiency of an insulation door for the inside of a low-temperature storage and an operability of a control panel.

Figure 10:
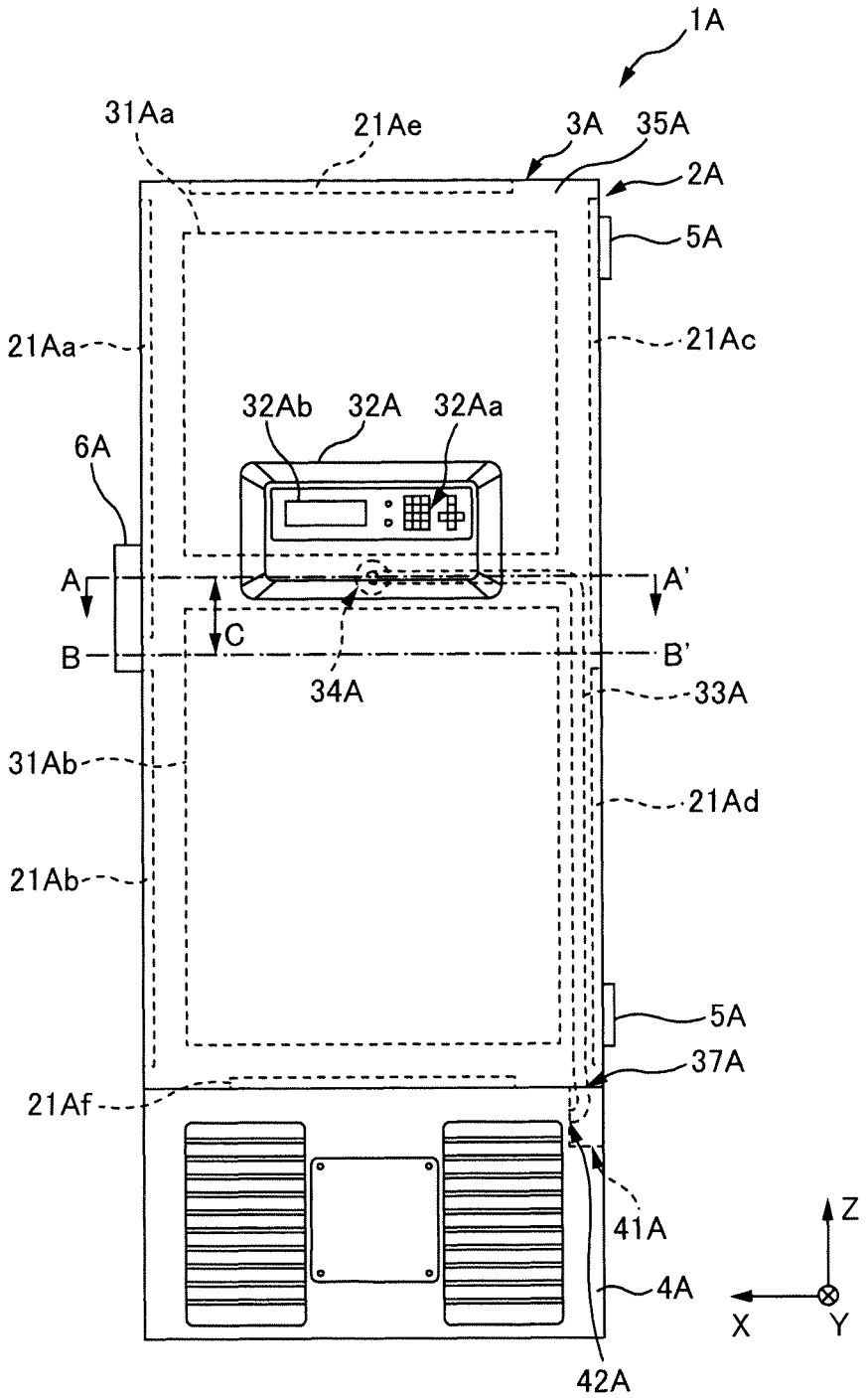
FIG. 10 is a front view of a low-temperature storage LA according to a third embodiment.
Figure 11:
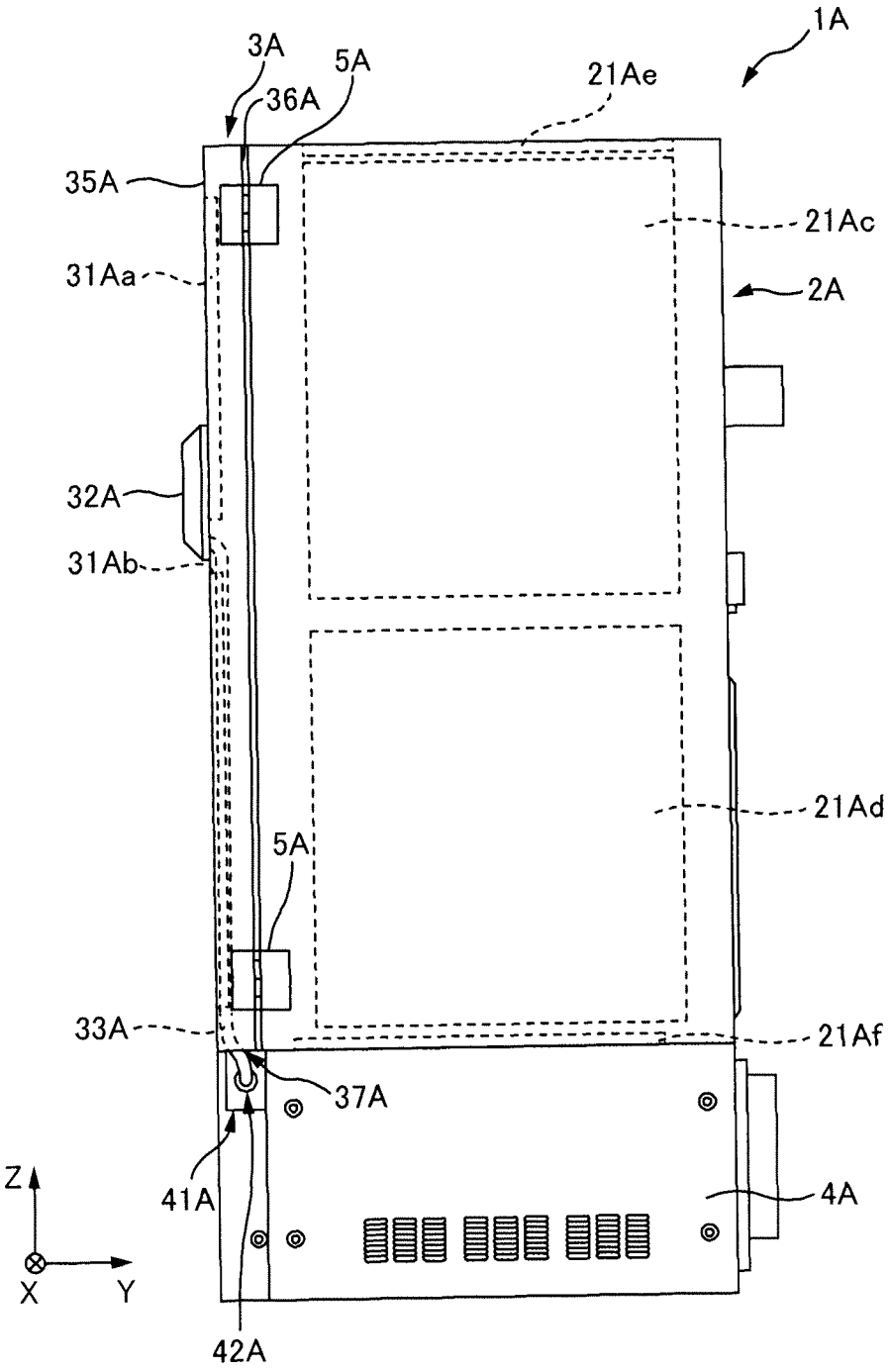
FIG. 11 is a side view of the low-temperature storage LA of FIG. 10 when seen from the right end side in a −X direction in FIG. 10.
Figure 12:
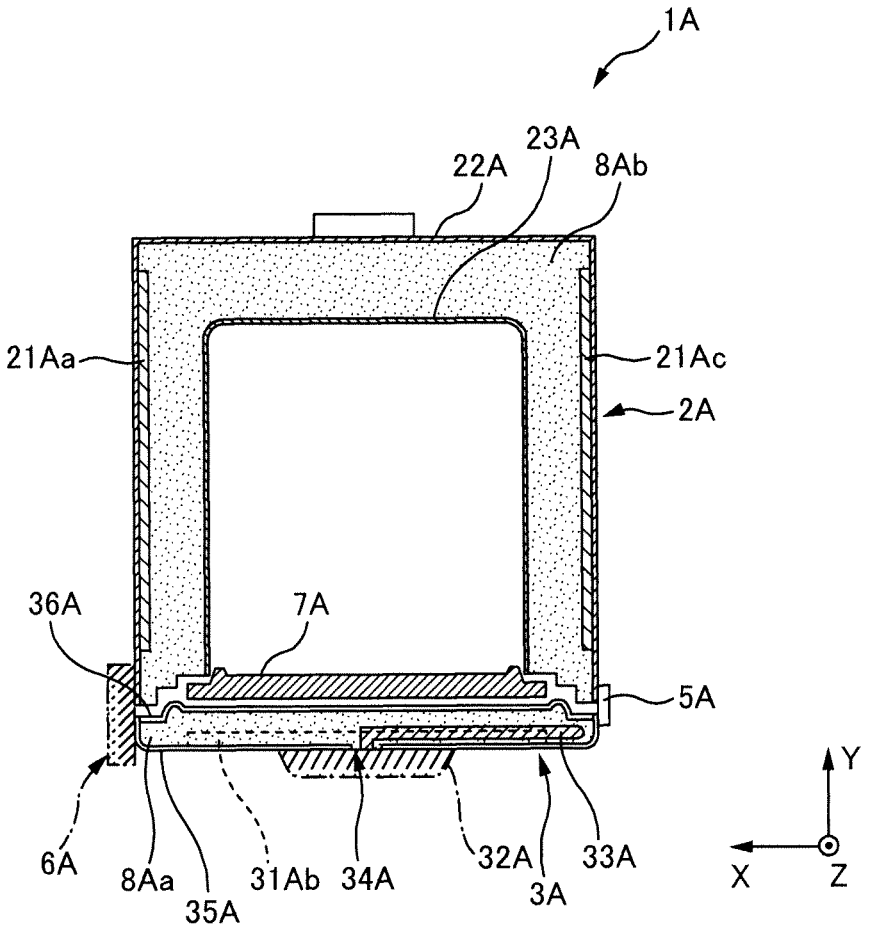
FIG. 12 is a sectional view of the low-temperature storage 1 of FIG. 10 when seen from a direction of an arrow of A-A' in FIG. 10.

Referring to FIGS. 10 to 12, a configuration example of a low-temperature storage 1A according to a third embodiment will be described below. FIG. 10 is a front view of the low-temperature storage 1A. FIG. 11 is a side view of the low-temperature storage 1A of FIG. 10 seen from the right end side in −X direction in FIG. 10. FIG. 12 is a sectional view of the low-temperature storage 1A of FIG. 10 seen from a direction of arrows A-A' in FIG. 10. In FIGS. 10 to 12, the X-axis is the right-left direction with respect to the low-temperature storage 1A, the Y-axis is the front-back direction with respect to the low-temperature storage 1A, and the Z-axis is the vertical direction with respect to the low-temperature storage 1A.

The low-temperature storage 1A has an insulation housing 2A having an opening on a front face (−Y direction), an insulation outer door 3A (insulation door) configured to open or close the opening of the insulation housing 2A, and a machine chamber 4A provided on a lower side of the insulation housing 2A (−Z direction).

In the machine chamber 4A, a configuration of a refrigerating apparatus, except an evaporator, is housed and the refrigerating apparatus includes a first refrigerant circuit including a first compressor, a first condenser, a first decompressing device, and a first evaporator circularly connected with a refrigerant piping and a second refrigerant circuit, substantially the same as the first refrigerant circuit, including a second compressor, a second condenser, a second decompressing device, and a second evaporator circularly connected with the refrigerant piping (none of them being shown). Two pipes constituting evaporators of the first and second refrigerant circuits, respectively, are provided in such a manner that they meander from a top face outside the storage of an inner box 23A constituting the insulation housing 2A, which will be described later, along both side faces and a back face so that they are not overlapped with each other and attached to a wall face (not shown). The inside of the inner box 23A is the inside of the low-temperature storage 1A. When the refrigerating apparatus is operated, the refrigerant circulates in the refrigerant circuit through the refrigerant piping. As a result, air in the low-temperature storage 1A is heat-exchanged with the pipe, and the inside of the storage is cooled.

Below the insulation outer door 3A on the side face at the right end on the front (−X direction) of the machine chamber 4A, a dent 41A having a predetermined length is provided from an upper end to a lower end of the side face. Also, inside the dent 41A, a through hole 42A is provided. The through hole 42A is configured to pass a wiring 33A from the refrigerating apparatus to the outside of the machine chamber 4A. The wiring 33A electrically connects the refrigerating apparatus and a control panel 32A, which will be described later, with one end connected to the refrigerating apparatus and the other end to the control panel 32A. Specifically, the one end of the wiring 33A is connected to the compressor constituting the refrigerating apparatus, a fan motor (not shown) configured to radiate heat of the condenser and the like. The dent 41A forms a space required for passing the wiring 33A between the through hole 42A and a through hole 37A, which will be described later, provided in a bottom face of the insulation outer door 3A.

On the side faces at the right end on the front of the insulation housing 2A and the insulation outer door 3A, hinges 5A are provided. The insulation outer door A3 rotates about the right end on the front in the insulation housing 2A.

On the side faces of the left end on the front (X direction) of the insulation housing 2A and the insulation outer door 3A, a handle 6A is provided. The handle 6A is operated when the opening of the insulation housing 2A is to be opened or closed by the insulation outer door 3A. Also, the handle 6A is provided with a lock mechanism (not shown) that can fix a state in which the opening of the insulation housing 2A is closed by the insulation outer door 3A.

On an outer face of an outer plate 35A, which will be described later, constituting the insulation outer door 3A, the control panel 32A is provided. The control panel 32A is to operate the refrigerating apparatus. For example, with the above operation, an operation state of the compressor of the refrigerating apparatus is controlled and a cooling temperature in the low-temperature storage 1A and the like can be adjusted. Also, the control panel 32A has a keyboard 32Aa, which is an operation input device, and a liquid crystal display 32Ab, which is a display device. The above operations are carried out by the keyboard 32Aa. On the liquid crystal display 32Ab, a set temperature, a storage temperature, operation states of the first and second refrigerant circuits, respectively, an operation state of the keyboard 32Aa and the like are displayed. Since it is difficult to operate the control panel 32A if it is located at a low position, in this embodiment, the panel is provided above the center in the height direction of the insulation outer door 3A to improve operability.

The insulation housing 2A has an outer box 22A and an inner box 23A made of, for example, metal vacuum insulation panels 21Aa, 21Ab, 21Ac, 21Ad, 21Ae, 21Af (third vacuum insulation panel), and a foam insulation material 8Ab (second foam insulation material). The outer box 22A and the inner box 23A have an opening on the front face, and the outer box 22A covers the inner box 23A. The vacuum insulation panels 21Aa to 21Af and the foam insulation material 8Ab are provided between the outer box 22A and the inner box 23A in order to improve the insulation effect for the inside of the storage in the insulation housing 2A.

The vacuum insulation panels 21Aa to 21Af are made of a film formed in a bag shape and a core material filled inside the film, and air is drained so that a space inside the film ensured by the core material is brought into a vacuum state. The core material is made of glass wool and the like that does not produce gas, for example. The film is made of aluminum and the like that prevents transmission of gas, for example.

The vacuum insulation panels 21Aa to 21Af are attached on a wall face of the outer box 22A between the outer box 22A and the inner box 23A. As a result, the vacuum insulation panels 21Aa to 21Af are separated from the inner box 23A and the above pipe between the outer box 22A and the inner box 23A and are prevented from being cooled to an allowable temperature or below. Specifically, on the side face at the left end on the front of the outer box 22A, the vacuum insulation panel 21Aa is attached on the upper side (Z-direction) and the vacuum insulation panel 21Ab on the lower side. On the side face at the right end on the front of the outer box 22A, the vacuum insulation panel 21Ac is attached on the upper side and the vacuum insulation panel 21Ad on the lower side. On the top face of the outer box 22A, the vacuum insulation panel 21Ae is attached. On the bottom face of the outer box 22A, the vacuum insulation panel 21Af is attached. Each of the vacuum insulation panels 21Aa to 21Ad has substantially the same size.

The foam insulation material 8Ab is filled between the outer box 22A and the inner box 23A except portions of the above-mentioned pipe and the vacuum insulation panels 21Aa to 21Af. At that time, in this embodiment, a thickness of the foam insulation material 8Ab in the portion between the outer box 22A and the inner box 23A where the vacuum insulation panels 21Aa to 21Af are not attached is set to be twice or more of a thickness of the vacuum insulation panels 21Aa to 21Af. For example, the foam insulation material 8Ab is filled after the vacuum insulation panels 21Aa to 21Af are attached on the wall face of the outer box 22A. In a case where the foam insulation material 8Ab is filled as above, the foam insulation material 8Ab presses the vacuum insulation panels 21Aa to 21Af. Moreover, in a case where the foam insulation material 8Ab is made of a foam polyurethane resin, when the polyurethane resin is foamed, it adheres to the wall faces of the outer box 22A and the inner box 23A and the vacuum insulation panels 21Aa to 21Af. Thus, the vacuum insulation panels 21Aa to 21Af are reliably fixed to the wall face of the outer box 22A.

The inner box 23A is provided with an inner door 7A configured to rotate around the front end on the side face at the right end on the front of the inner box 23A to open or close the opening of the inner box 23A. The inner door 7A is, for example, made of a resin and is configured to improve the insulation effect for the inside of the low-temperature storage 1A.

The insulation outer door 3A has the outer plate 35A and an inner plate 36A made of, for example, metal vacuum insulation panels 31Aa (first vacuum insulation panel), 31Ab (second vacuum insulation panel), and a foam insulation material 8Aa (first foam insulation material). The insulation outer door 3A is configured by being surrounded by the outer plate 35A and the inner plate 36A. The outer plate 35A constitutes a wall outside the storage of the insulation outer door 3A. The inner plate 36A constitutes a wall inside the storage of the insulation outer door 3A. The vacuum insulation panels 31Aa and 31Ab and the foam insulation material 8Aa are provided inside the insulation outer door 3A in order to improve the insulation effect for the inside of the storage of the insulation outer door 3A.

The vacuum insulation panels 31Aa and 31Ab include a film and a core material similarly to the vacuum insulation panels 21Aa to 21Af. Also, the vacuum insulation panels 31Aa and 31Ab are attached to the inner face of the outer plate 35A. As a result, the vacuum insulation panels 31Aa and 31Ab are separated from the inside of the storage in the insulation outer door 3A and prevented from being cooled to an endurance temperature or below. Specifically, the vacuum insulation panel 31Aa is attached to the upper side of the outer plate 35A and the vacuum insulation panel 31Ab to the lower side. The vacuum insulation panels 31Aa and 31Ab are in a square shape, and a width in the right-left direction is longer than a width in the right-left direction of the opening of the inner box 23A. Also, the vacuum insulation panel 31Aa on the upper side has a width in the vertical direction shorter than that of the vacuum insulation panel 31Ab on the lower side.

In the outer plate 35A constituting the bottom face of the insulation outer door 3A, the through hole 37A is provided above the dent 41A. The through hole 37A is configured pass the wiring 33A therethrough to the inside of the insulation outer door 3A.

In the outer plate 35A at a position indicated by A-A' in FIG. 10 substantially in the middle of the right-left direction of the insulation outer door 3A, a through hole 34A is provided. The through hole 34A is for connecting the control panel 32A and the wiring 33A passing through the inside of the insulation outer door 3A. Thus, the control panel 32A is fixed to the outer plate 35A with a screw or the like so as to cover the through hole 34A. On the back face side (Y-direction) of the control panel 32A, the wiring 33A and the control panel 32A are connected to each other through the through hole 34A.

A-A' in FIG. 10 indicates a position of a gap between the vacuum insulation panel 31Aa and the vacuum insulation panel 31Ab that is above almost the middle (B-B' in FIG. 1) in the vertical direction of the insulation outer door 3A by approximately a distance C. Thus, the through hole 34A is provided avoiding the vacuum insulation panels 31Aa and 31Ab, and the film constituting the vacuum insulation panels 31Aa and 31Ab is prevented from losing sealing performance. That is, deterioration in the insulation effect of the vacuum insulation panels 31Aa and 31Ab is prevented.

The foam insulation material 8Aa is filled inside the insulation outer door 3A except portions of the vacuum insulation panels 31Aa and 31Ab and the wiring 33A. At this time, in this embodiment, a thickness of the foam insulation material 8Aa in the portion between the outer plate 35A and the inner plate 36A where the vacuum insulation panels 31Aa and 31Ab are not attached is set to be twice or more of a thickness of the vacuum insulation panels 31Aa and 31Ab. For example, the foam insulation material 8Aa is filled in a state in which the vacuum insulation panels 31Aa and 31Ab are attached to the outer plate 35A and the wiring 33A is passed through the inside of the insulation outer door 3A. As a result, similarly to the case of the foam insulation material 8Ab, the vacuum insulation panels 31Aa and 31Ab are reliably fixed to the outer plate 35A. Moreover, the wiring 33A is fixed to a place where the foam insulation material 8Aa is filled inside the insulation outer door 3A.

The wiring 33A is arranged so as not to contact the vacuum insulation panels 31Aa and 31Ab inside the insulation outer door 3A. As a result, damage on the film and the wiring 33A constituting the vacuum insulation panels 31Aa and 31Ab is prevented. Also, the wiring 33A is arranged on the front face side inside the insulation outer door 3A avoiding the interval between the vacuum insulation panels 31Aa and 31Ab and the inside of the storage. As a result, the wiring 33A is separated from the inside of the storage inside the insulation outer door 3A and prevented from being cooled to an endurable temperature or below.

Figure 13:
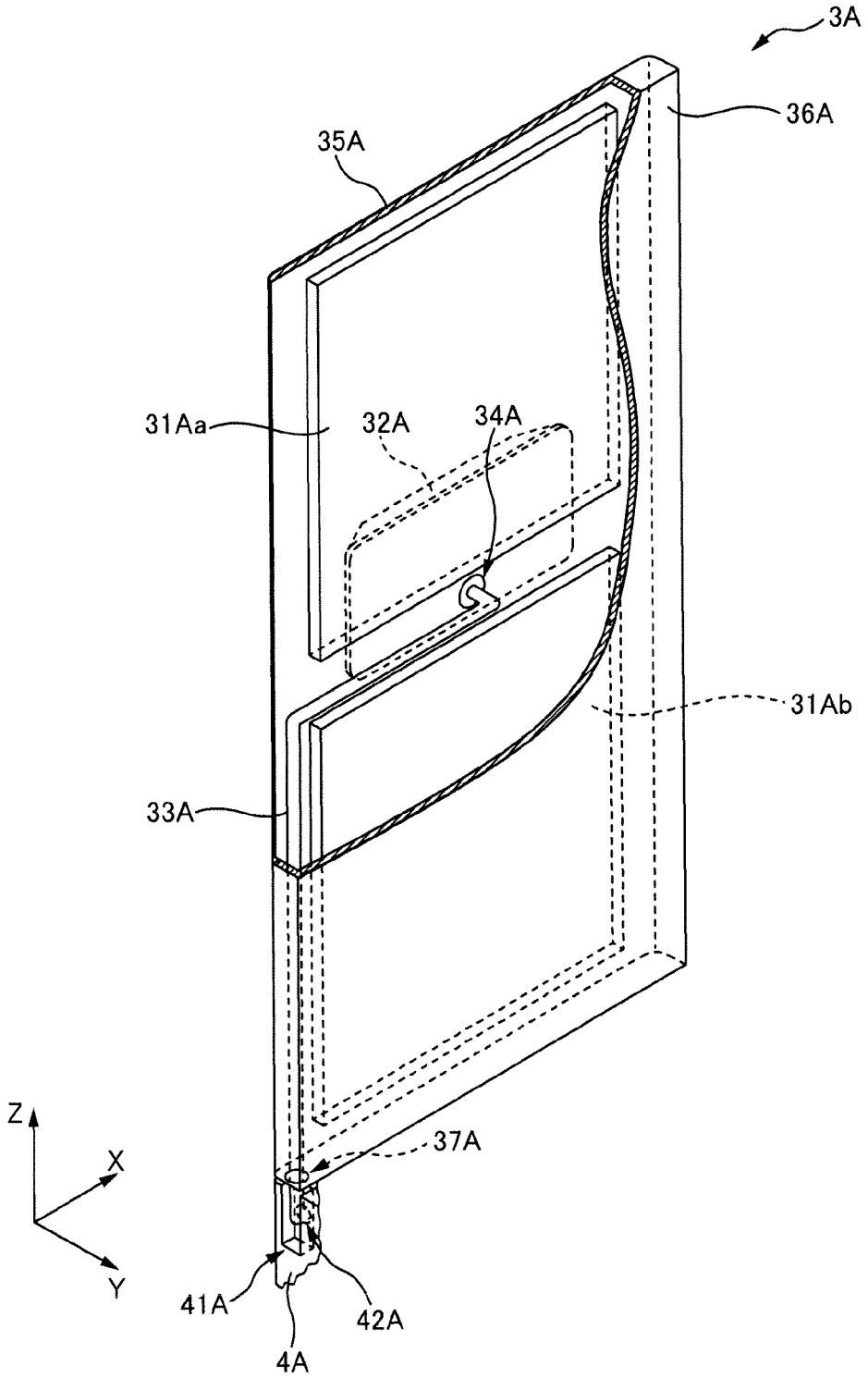
FIG. 13 is a perspective view illustrating an insulation outer door 3A, a machine chamber 4A, and a wiring 33A of the low-temperature storage 1A.

Referring to FIG. 13, a state in which the wiring 33A in the low-temperature storage 1A is passed through the inside of the insulation outer door 3A from the control panel 32A with the above-mentioned arrangement and led to the machine chamber 4A will be specifically described below.

FIG. 13 is a perspective view illustrating the insulation outer door 3A, the machine chamber 4A, and the wiring 33A of the low-temperature storage 1A. For convenience of the description, in the insulation outer door 3A in FIG. 13, a part of the outer plate 35A and the inner plate 36A and the foam insulation material 8Aa are omitted. Also, in the machine chamber 4A in FIG. 13, a portion other than the portion including the dent 41A and the through hole 42A is omitted. Also, in the wiring 33A in FIG. 13, the above one end side inside the machine chamber 4A is omitted. Also, in FIG. 13, the X-axis is referred to as the right-left direction with respect to the low-temperature storage 1A, the Y-axis as the front-back direction to the low-temperature storage 1A, and the Z-axis as the vertical direction to the low temperature storage 1A.

The wiring 33A is introduced from the control panel 32A to the inside of the insulation outer door 3A through the through hole 32A. The wiring 33A is arranged so as to go toward the right side on the front of the insulation outer door 3A from the through hole 34A in the gap between the vacuum insulation panels 31Aa and 31Ab. Also, the wiring 33A is arranged so as to go toward the through hole 37A passing between the side face at the right end on the front of the insulation outer door 3A and the side face at the right end on the front of the vacuum insulation panel 31Ab. And the wiring 33A is led to the outside of the insulation outer door 3A through the through hole 37A and introduced into the machine chamber 4A through the through hole 42A.

As mentioned above, in the low-temperature storage 1A according to this embodiment, the vacuum insulation panel 31Ab provided on the lower side of the insulation outer door 3A is larger than the vacuum insulation panel 31Aa provided on the upper side of the insulation outer door 3A. Thus, in the low-temperature storage 1A, even if the temperature of the air in the lower side in the storage becomes lower than the temperature of the air in the upper side in the storage, a favorable insulation effect by the insulation outer door 3A can be obtained for the upper and lower sides in the storage.

Also, in the insulation outer door 3A of the low-temperature storage 1A according to this embodiment, A-A' in FIG. 10 is above B-B' in FIG. 10 by the distance C. As a result, the control panel 32A can be arranged above the center in the height direction of the insulation outer door 3A, and favorable operability can be ensured.

In this embodiment, the vacuum insulation panels 31Aa and 31Ab are formed in a square shape, but it is not limited thereto. For example, the vacuum insulation panels 31Aa and 31Ab may be in a shape other than a square so that the wiring 33A can be arranged easily inside the insulation outer door 3A.

Also, in this embodiment, the position where the through hole 34A is provided is substantially the middle in the right-left direction of the insulation outer door 3A, but it is not limited thereto. For example, the position where the through hole 34A is provided may be on the right side on the front from the substantially the middle in the right-left direction of the insulation outer door 3A. As a result, the length of the wiring 33A can be reduced.

Also, in this embodiment, in a state where the vacuum insulation panels 31Aa and 31Ab are attached to the outer plate 35A, and the wiring 33A is passed through the inside of the insulation outer door 3A, the foam insulation material 8Aa is filled, but it is not limited thereto. For example, the foam insulation material 8Aa may be filled inside the insulation outer door 3A after being molded according to the shapes of the vacuum insulation panels 31Aa and 31Ab, the wiring 33A and the like. Also, the foam insulation material 8Ab may also be filled inside the insulation housing 2A after being molded according to the shapes of the vacuum insulation panels 21Aa to 21Af and the like.

As the refrigerating apparatus in the low-temperature storage 1A, the refrigerant circuit 100 in the first embodiment can be employed. Alternatively, as the refrigerating apparatus in the low-temperature storage 1A, the first refrigerant circuit 300 and the second refrigerant circuit 400 of the second embodiment can be employed and the first evaporation pipe 311 and the second evaporation pipe 411 of the second embodiment can be attached to the wall face so that they meander without overlapping each other from the top face outside storage along the both side faces and back face of the inner box 23A constituting the insulation housing 2A.

Fourth Embodiment

In a low-temperature storage used for storage of refrigerated articles or the like and cooled storage of biological tissues, specimens and the like, as a temperature inside the storage is decreased due to the cooling of the air inside the storage is, an atmospheric pressure inside the storage may be brought to a negative pressure that is lower than an atmospheric pressure outside the storage. Thus, in Japanese Patent Laid-Open No. H05-141848, for example, in order to eliminate the negative pressure state inside the storage, a low-temperature storage provided with a pressure regulating port penetrating a door and an opening/closing valve configured to open/close the pressure regulating port in conjunction with an operation of an operation lever configured to open/close the door is disclosed.

However, the above low-temperature storage needs a mechanism by which the operation lever works in conjunction with the opening/closing valve. Moreover, in the above low-temperature storage, the pressure regulating port is opened/closed by the opening/closing valve each time the door is opened/closed by the operation of the operation lever whether atmospheric pressure regulation inside the storage is required or not. Thus, if opening/closing of the door is repeated, the mechanism interposed between the operation lever and the opening/closing valve may be deteriorated or damaged, and the pressure regulating port may not be able to be fully closed. As a result, cool air may leak out from the inside of the storage through the pressure regulating port.

Accordingly, the refrigerating apparatus according to this embodiment has an object to surely solve the negative pressure inside the low-temperature storage.

Figure 14:
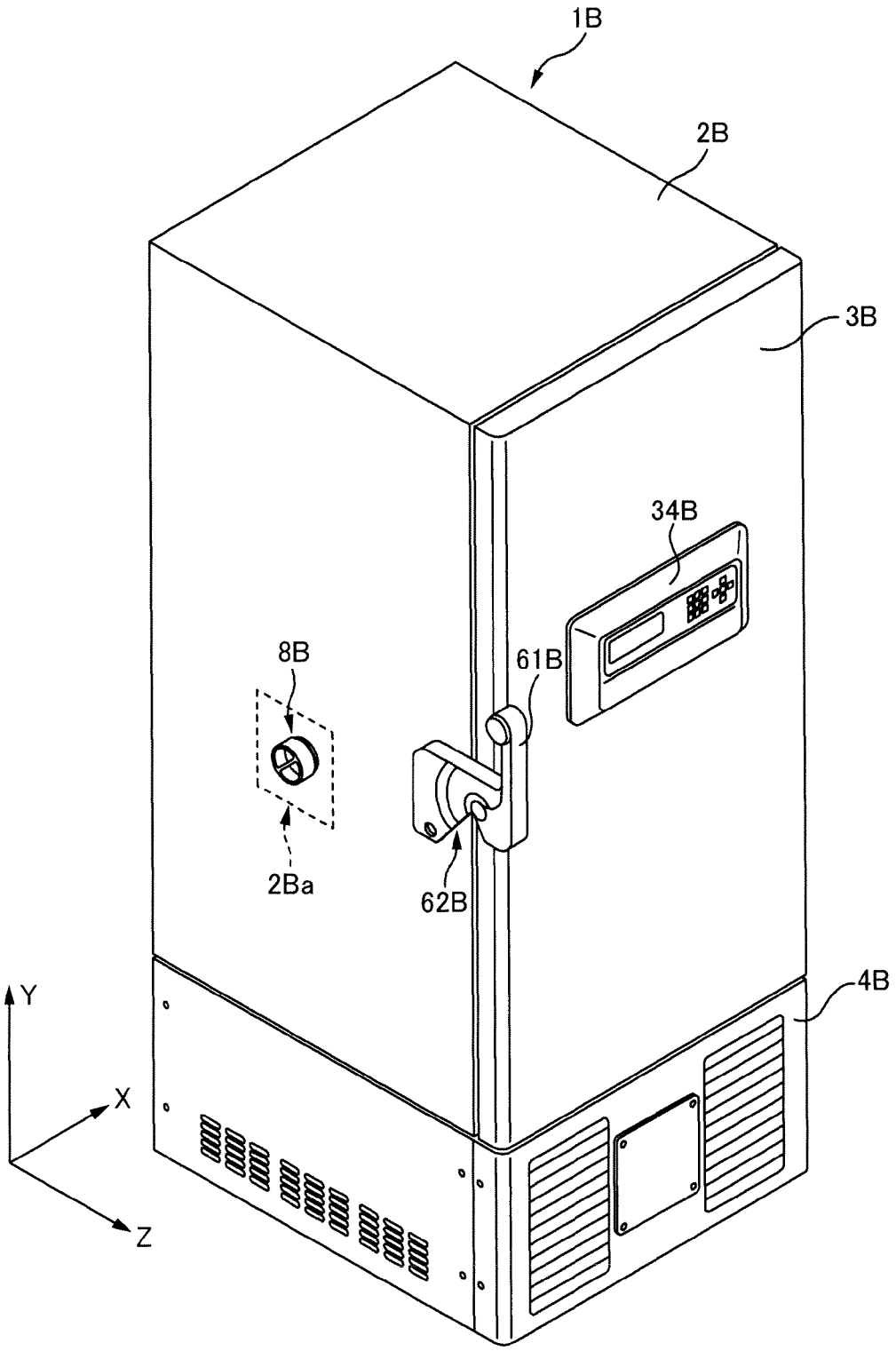
FIG. 14 is a perspective view of a low-temperature storage 1B according to a fourth embodiment.

Referring to FIG. 14, a configuration of a low-temperature storage 1B will be described. FIG. 14 is a perspective view of the low-temperature storage 1B according to a fourth embodiment. In FIG. 14, the X-axis is referred to as the right-left direction with respect to the low-temperature storage 1B, the Y-axis as the vertical direction to the low-temperature storage 1B, and the Z-axis as the front-back direction to the low-temperature storage 1B. The low-temperature storage 1B preserves refrigerated articles or the like or stores biological tissues or the like in an ultralow-temperature region at or below −85° C., for example.

The low-temperature storage 1B has an insulation housing 2B having an opening face on a front face, the insulation outer door 3B configured to open or close the opening face of the insulation housing 2B, and a machine chamber 4B provided at a lower part in the −Y direction of the insulation housing 2B. In the machine chamber 4B, a configuration of a refrigerating apparatus including a compressor, a condenser, a decompressor, and an evaporator, not shown, excluding the evaporator is housed. Also, the insulation housing 23 has, as will be described later, an outer box 21B constituting a wall face of the outside of the storage and an inner box 22B constituting a wall face of the inside of the storage. A pipe constituting the evaporator is mounted around the side face of the inner box 22B between the outer box 21B and the inner box 22B of the insulation housing 2B so as to perform heat exchange with the inside of the storage. Thus, when the refrigerating apparatus is operated and the refrigerant is circulated through the compressor, condenser, decompressor, and evaporator through the refrigerant piping, the inside of the low-temperature storage 1B is cooled.

On the front face of the insulation outer door 3B, a control panel 34B for setting a temperature inside the storage or the like is provided. The insulation outer door 3B is mounted on the insulation housing 2B so as to rotate about the right end in the X-direction in the insulation housing 2B. At the left end in the −X direction in the insulation outer door 3B, a lever 61B for opening/closing operation of the insulation outer door 3B is provided. At the front end in the Z direction on the side face in the −X direction in the insulation housing 2B, a locking portion 62B is provided which engages with the lever 61B when the insulation outer door 3B is closed and which disengages from the lever 61B when the insulation outer door 3B is opened.

On the side face at the left end in the −X direction in the insulation housing 2B, an in-storage pressure regulating device 8B is provided along with the locking portion 62B. In a case where the air inside the low-temperature storage 1B is cooled and contracted, the atmospheric pressure inside the storage is brought to a negative pressure lower than the atmospheric pressure outside the storage. The in-storage pressure regulating device 8B eliminates the negative pressure state by adjusting the atmospheric pressure inside the storage, in a case where the pressure becomes so negative that it is difficult to open the insulation outer door 3B.

Figure 15A:
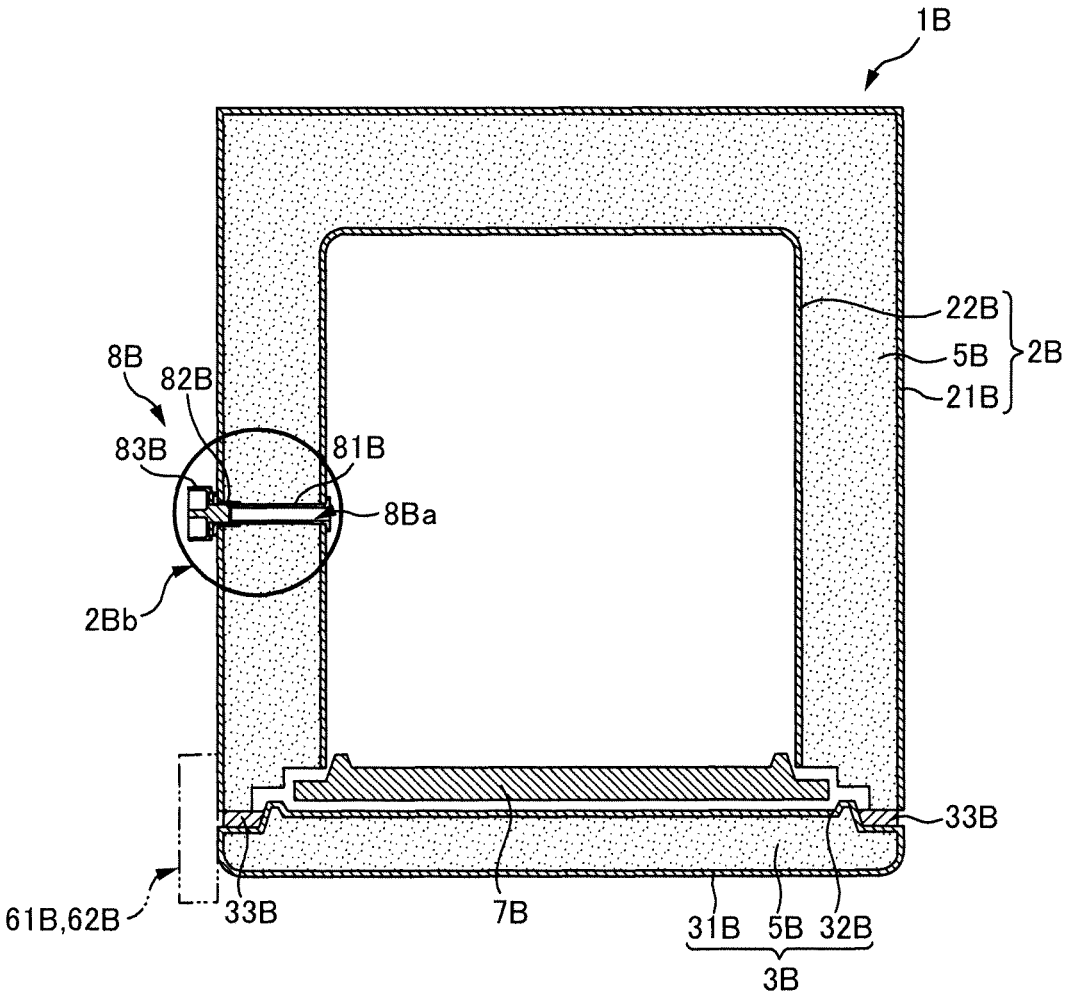
FIG. 15A is a plan view of the low-temperature storage 1B according to the fourth embodiment.
Figure 15B:
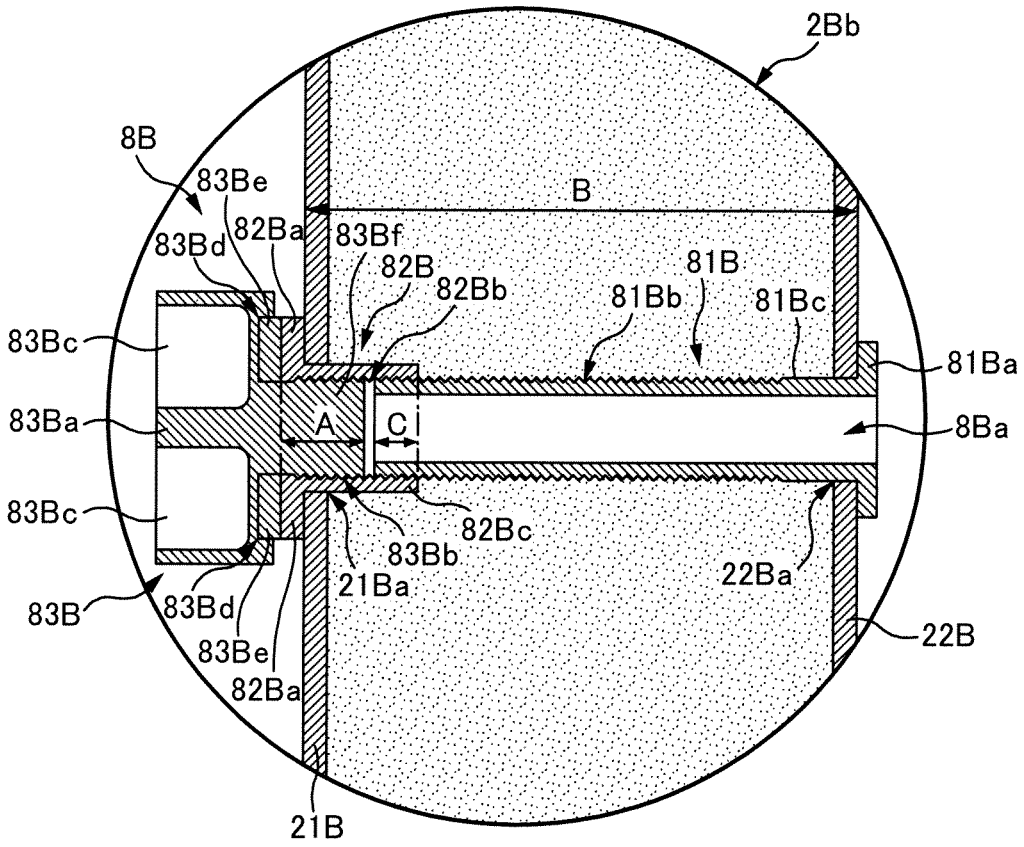
FIG. 15B is an enlarged view of a portion surrounded by a circle 2Bb of FIG. 15A.

Referring to FIGS. 15A and 15B, a structure of the in-storage pressure regulating device 8B will be described. FIG. 15A is a plan view of the low-temperature storage 1B according to the fourth embodiment. FIG. 15B is an enlarged diagram of a portion surrounded by a circle 2Bb in FIG. 15A.

The in-storage pressure regulating device 8B has a first member 82B, a second member 81B, and a third member 83B. The first member 82B includes a first cylinder portion 82Bc and a first flange portion 82Ba which are made of, for example, a resin. In the first cylinder portion 82Bc, a female screw 82Bb is formed. The first flange portion 82Ba is integrally formed with the first cylinder portion 82Bc at one end of the first cylinder portion 82Bc. The second member 81B includes a second cylinder portion 81Bc and a second flange portion 81Ba which are, for example, made of a resin. In the second cylinder portion 81Bc, a male screw 81Bb to be screwed with the female screw 82Bb of the first cylinder portion 82Bc is formed. The second flange portion 81Ba is integrally formed with the second flange portion 81Bc at one end of the second cylinder portion 81Bc.

The third member 83B includes a plug 83Bf (plug portion) and a knob 83Ba (grasping portion) which are, for example, made of a resin. In the plug 83Bf, a male screw 83Bb to be screwed with the female screw 82Bb of the first cylinder portion 82Bc is formed. A distance from one end to the other end of the plug 83Bf (distance shown by A in FIG. 15B) is a predetermined length, which will be described later. The knob 83Ba is formed integrally with the plug 83Bf at one end of the plug 83Bf and has a columnar shape with a diameter longer than the plug 83Bf, for example. The third member 83B may be made of an ABS resin from a viewpoint of heat conductivity, workability and the like to form the male screw 83Bb. Also, in an end face of the knob 83Ba opposite to the plug 83Bf, an insertion hole 83Bc through which a finger can be inserted is provided so that the knob 83Ba can be easily grasped when the male screw 83Bb and the female screw 82Bb are to be screwed together. Also, in an end face of the knob 83Ba on the plug 83Bf side, a groove 83Bd is provided along the circumference of the plug 83Bf, and a packing 83Be is fitted in the groove 83Bd.

A configuration of each of the in-storage pressure regulating device 8B is provided with respect to the insulation housing 2B as follows. The insulation housing 2B includes the outer box 21B, which will be described later, the inner box 22B, and a foam insulation material 5B. A wall face outside the storage of the insulation housing 2B is a wall face outside the storage of the outer box 21B, and a wall face inside the storage of the insulation housing 2B is a wall face inside the storage of the inner box 22B. The outer box 21B is provided with a through hole 21Ba, which will be described alter, penetrating the wall face of the outer box 21B. The inner box 22B is provided with a through hole 22Ba, which will be described later, penetrating the wall face of the inner box 22B.

The first cylinder portion 82Bc is inserted into the through hole 21Ba from an outside of the storage of the outer box 21B, and the second cylinder portion 81Bc is inserted into the through hole 22Ba from an inside of the storage of the inner box 22B. By screwing the male screw 81Bb with the female screw 82Bb between the outer box 21B and the inner box 22B, the first flange portion 82Ba is brought into contact with the wall face of the outer box 21B from outside the storage, and the second flange portion 81Ba is brought into contact with the wall face of the inner box 22B from inside the storage. Thus, the first member 82B and the second member 81B are joined in such a manner that the screwed first cylinder portion 81Bc and the second cylinder portion 82Bc penetrate the wall faces inside and outside the storage of the insulation housing 2B, and the first flange portion 82Ba and the second flange portion 81Ba press the wall faces of the insulation housing 2B from inside and outside the storage of the insulation housing 2B.

By means of a hollow portion of the integrally joined first member 82B and the second member 81B, an in-storage pressure regulating path 8Ba communicating between inside and outside of the insulation housing 2B is formed between wall faces of the outer box 21B and the inner box 22B. The plug 83Bf is inserted into the in-storage pressure regulating path 8Ba from outside the storage of the outer box 21B, and the male screw 83Bb and the female screw 82Bb are screwed together. As a result, the third member 83B is mounted on the in-storage pressure regulating path 8Ba in such a manner that the packing 83Be is abutted to the periphery of the opening outside the storage of the first flange portion 82Ba. The third member 83B is detachable with respect to the in-storage pressure regulating path 8Ba. In a case where the third member 83B is mounted on the in-storage pressure regulating path 8Ba, the in-storage pressure regulating path 8Ba is closed. In a case where the third member 83B is removed from the in-storage pressure regulating path 8Ba, the in-storage pressure regulating path 8Ba is opened.

Subsequently, the insulation housing 2B has the outer box 21B and the inner box 22B made of, for example, metal and the foam insulation material 5B. The outer box 21B and the inner box 22B have an opening face on the front face, and the outer box 21B covers the inner box 22B. Also, the outer box 21B is provided with the through hole 21Ba. The through hole 21Ba has a diameter larger than the outer diameter of the first cylinder portion 82Bc and shorter than the diameter of the first flange portion 82Ba. The inner box 22B is provided with the through hole 22Ba at a position opposing the through hole 21Ba. The through hole 22Ba has a diameter larger than the outer diameter of the second cylinder portion 81Bc and shorter than the diameter of the second flange portion 81Ba.

The foam insulation material 5B is filled between the outer box 21B and the inner box 22B in order to improve insulation of the insulation housing 2B. The foam insulation material 5B is filled by directly foaming a raw liquid of polyurethane resin between the outer box 21B and the inner box 22B, for example. Filling of the foam insulation material 5B is, for example, performed while the female screw 82Bb and the male screw 81Bb are screwed between the outer box 21B and the inner box 22B and the first member 82B and the second member 81B are joined. In a case where the foam insulation 5B is filled while the first member 82B and the second member 81B are joined as above, the filled foam insulation material 5B presses the first cylinder portion 82Bc and the second cylinder portion 81Bc. Moreover, in a case where the foam insulation material 5B is made of foam polyurethane resin, when the polyurethane resin is foamed, it adheres to the wall faces of the outer box 21B and the inner box 22B, the first cylinder portion 82Bc, and the second cylinder portion 81Bc. Thus, the first member 82B and the second member 81B are fixed so as not to be able to move in the through holes 21Ba and 22Ba of the insulation housing 2B, and it becomes difficult to release screwing between the female screw 82Bb and the male screw 81Bb.

The insulation outer door 3B has the outer plate 31B and the inner plate 32B made of, for example, metal. Between the outer plate 31B and the inner plate 32B, the foam insulation material 5B is filled by the method similar to the case in which the foam insulation material 5B is filled between the outer box 21B and the inner box 22B, for example. On a peripheral edge portion inside the storage of the insulation outer door 3B, a packing 33B is provided so that a gap is not produced between the insulation outer door 3B and the insulation housing 2B when the insulation outer door 3B closes the opening face of the insulation housing 2B. Inside the storage of the insulation outer door 3B in the low-temperature storage 1B, an insulation inner door 7B configured to open or close the opening face of the inner box 22B is provided in order to improve insulation in the storage.

As mentioned above, in a case where the in-storage pressure regulating path 8Ba and the insulation outer door 3B are closed in the low-temperature storage 1B, air tightness in the storage is maintained and leakage of cool air from inside to the outside of the storage is prevented. Also, in a case where the inside of the low-temperature storage 1B is in the negative pressure state in which opening of the insulation outer door 3B is difficult, when the in-storage pressure regulating path 8Ba is opened, inside and the outside of the storage is made to communicate with each other, and air outside the storage flows into the inside which has been substantially in a sealed state. As a result, the negative pressure state inside the low-temperature storage 1B is eliminated, and the insulation outer door 3B can be opened easily.

Here, from the opened in-storage pressure regulating path 8Ba, heat outside the storage can easily enter the inside of the low-temperature storage 1B. Thus, other than the case in which the negative pressure inside the low-temperature storage 1B is to be eliminated, it is necessary to close the in-storage pressure regulating path 8Ba by the third member 83B so as to prevent intrusion of heat from outside the storage. When the in-storage pressure regulating path 8Ba is to be closed by the third member 83B, the plug 83Bf is screwed into the in-storage pressure regulating path 8Ba. In the in-storage pressure regulating path 8Ba, a portion into which the plug 83Bf is inserted becomes difficult to transmit heat due to insulation of the plug 83Bf. Thus, a predetermined length from one end to the other end of the plug 83Bf is such a length that intrusion of heat outside the storage into the low-temperature storage 1B through in-storage pressure regulating path 8Ba closed by the third member 83B can be prevented.

An operation of the in-storage pressure regulating device 8B will be described below for a case in which the inside of the low-temperature storage 1B is in such a negative pressure state that opening of the insulation outer door 3B becomes difficult.

First, the knob 83Ba is grasped and the third member 83B is rotated in a direction to release screwing between the male screw 83Bb and the female screw 82Bb. As a result, by removing the third member 83B from the in-storage pressure regulating path 8Ba and opening the in-storage pressure regulating path 8Ba, and the negative pressure state inside the storage which makes it difficult to open the insulation outer door 3B is eliminated.

When the third member 83B is rotated, due to a frictional force generated between the third member 83B and the first member 82B, a force is also applied to the first member 82B and the second member 81B in the same direction as the rotation. However, as mentioned above, the first member 82B and the second member 81B are fixed by the foam insulation material 5B in the through holes 21Ba and 22Ba of the insulation housing 2B so as not to move. Thus, rotation of the first member 82B and the second member 81B with rotation of the third member 83B or release of the screwing between the female screw 82Bb and the male screw 81Bb is prevented.

Subsequently, the removed third member 83B is mounted on the in-storage pressure regulating path 8Ba, and the in-storage pressure regulating path 8Ba is returned to the closed state. Specifically, the third member 83B is mounted on the in-storage pressure regulating path 8Ba by rotating the male screw 83Bb and the female screw 82Bb in a screwing direction. As a result, the in-storage pressure regulating path 8Ba is closed again, and cool air in the storage is prevented from leaking from the in-storage pressure regulating path 8Ba.

Figure 16:
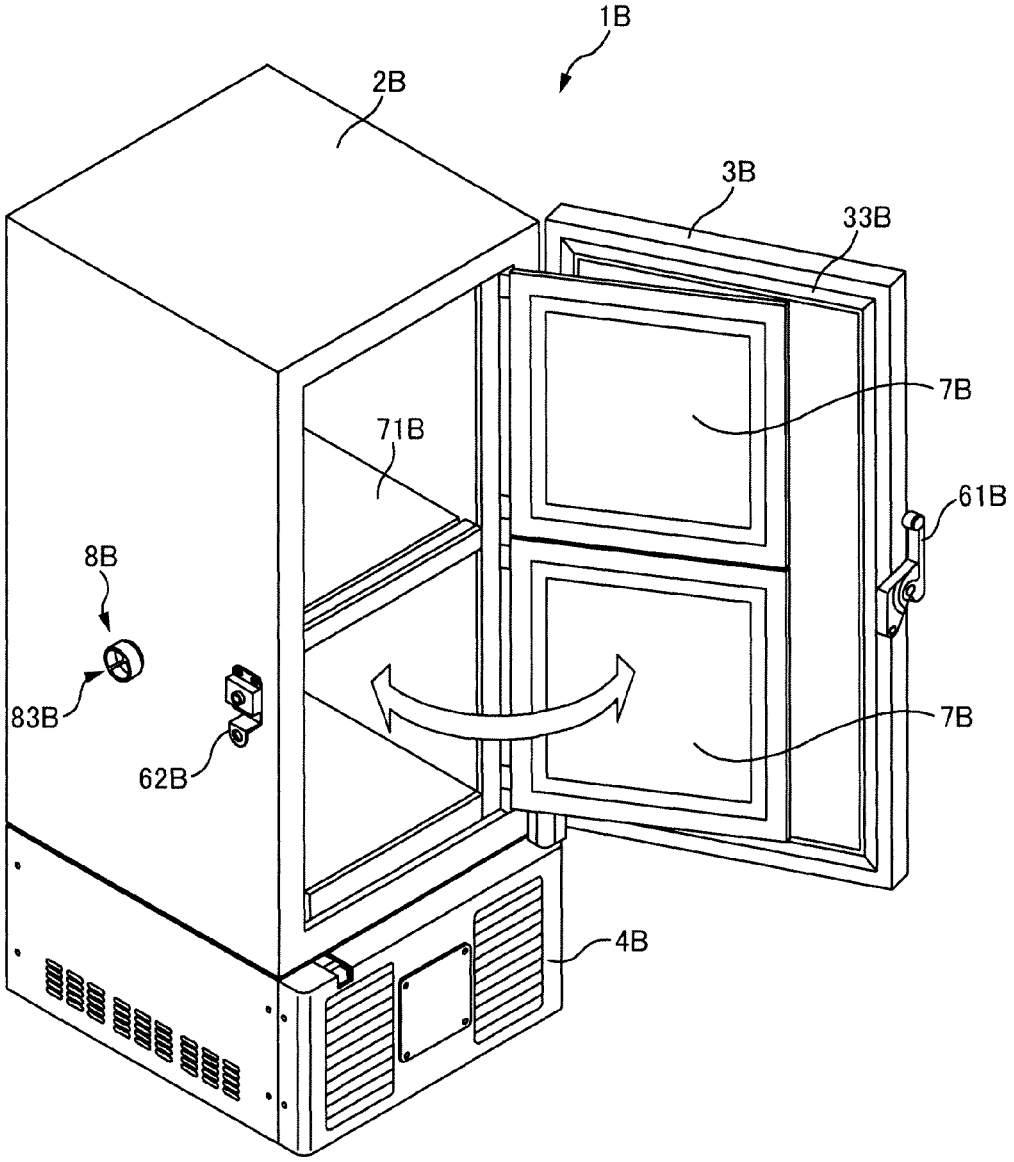
FIG. 16 is a perspective view illustrating a state of the low-temperature storage 1B when an insulation outer door 3B and an insulation inner door 7B are opened.

By the operation of the above in-storage pressure regulating path 8B, the negative pressure state in the low-temperature storage 1B that makes opening of the insulation outer door 3B difficult is eliminated. Therefore, the insulation outer door 3B and the insulation inner door 7B can be easily opened. A partition plate 71B provided in the low-temperature storage 1B shown in FIG. 16 partitions the inside of the low-temperature storage 1B.

As mentioned above, the in-storage pressure regulating device 8B according to this embodiment includes the first member 82B and the second member 81B in which the female screw 82Bb and the male screw 81Bb are screwed together, and the first flange portion 82Ba and the second flange portion 81Ba are joined so as to press the wall face of the insulation housing 2B. Thus, the in-storage pressure regulating device 8B has a simple structure provided with durability and can reliably eliminate the negative pressure inside the low-temperature storage 1B.

By the screwing between the male screw 81Bb and the female screw 82Bb, the other end side of the first cylinder portion 82Bc is inserted into the hollow portion of the second cylinder portion 81Bc from the other end side of the second cylinder portion 81Bc. Here, a distance from the other end of the first cylinder portion 82Bc inserted into the hollow portion to the other end of the second cylinder portion 81Bc (distance indicated by C in FIG. 15B) is referred to as a length of screwing between the male screw 81Bb and the female screw 82Bb. Also, a distance from the wall face outside the storage of the outer box 21B to the wall face inside the storage of the inner box 22B (distance indicated by B in FIG. 15B) is referred to as a thickness of the insulation housing 2B.

By providing a longer length for the screwing between the male screw 81Bb and the female screw 82Bb, a distance between the first flange portion 82Ba and the second flange portion 81Ba can be reduced. On the other hand, by providing a shorter length for the screwing between the male screw 81Bb and the female screw 82Bb, the distance between the first flange portion 82Ba and the second flange portion 81Ba can be made longer. That is, by adjusting the length of the screwing between the male screw 81Bb and the female screw 82Bb in the in-storage pressure regulating device 8B, the distance between the first flange portion 82Ba and the second flange portion 81Ba can be made as a distance in accordance with the thickness of the insulation housing 2B. Thus, since the first member 82B and the second member 81B can be provided in the low-temperature storage 1B according to the thickness of the insulation housing 2B, the in-storage pressure regulating device 8B has general versatility.

In the third member 83B, the plug 83Bf is screwed into the in-storage pressure regulating path 8Ba by screwing between the male screw 83Bb and the female screw 82Bb. Thus, the third member 83B can be firmly fixed to the in-storage pressure regulating path 8Ba. Also, in the third member 83B, the packing 83Be is brought into the periphery of the opening of the first flange portion 82Ba by the screwing between the male screw 83Bb and the female screw 82Bb. Thus, the third member 83B can reliably close the in-storage pressure regulating path 8Ba and prevent leakage of cool air inside the low-temperature storage 1B to the outside through the in-storage pressure regulating path 8Ba.

Also, since the third member 83B has the plug 83Bf with the predetermined length, intrusion of heat from the outside into the storage through the closed in-storage pressure regulating path 8Ba can be prevented. Also, since the plug 83Bf with the predetermined length is made of resin, heat is difficult to be transmitted, and thus, cooling of the third member 83B on the outside of the storage can be prevented. Thus, in the third member 83B, condensation on the knob 83Ba can be prevented.

The in-storage pressure regulating device 8B is provided together with the lever 61B and the locking portion 62B on the left end side in the −X direction in the low-temperature storage 1B. That is, the knob 83Ba, the lever 61B, and the locking portion 62B in a configuration extended toward the side faces of the insulation housing 2B and the insulation outer door 33 are provided together in the same direction in the low-temperature storage 1B. As a result, a space occupied by the low-temperature storage 1B can be saved. Also, the in-storage pressure regulating device 8B is provide in the vicinity of the lever 61B operated when the insulation outer door 3B is to be opened. Thus, it is easy to reach the in-storage pressure regulating device 8B, and operability is favorable.

In this embodiment, in the state where the first member 82 and the second member 81 are joined, the foam insulation material 5 is filled between the outer box 21 and the inner box 22, but it is not limited thereto. It may be so configured that after the foam insulation material 5 is filled between the outer box 21 and the inner box 22, the first member 82 and the second member 81 are joined in the through holes penetrating the foam insulation material 5 provided at a position corresponding the through holes 21*a* and 22*a* and the through holes 21*a* and 22*a*.

Also, in this embodiment, the first cylinder portion 82*c* is inserted into the through hole 21*a* from outside the storage of the outer box 21 and the second cylinder portion 81*c* is inserted into the through hole 22*a* from inside the storage of the inner box 22, but it is not limited thereto. For example, it may be so configured that the first cylinder portion 82*c* is inserted into the through hole 22*a* from inside the storage of the inner box 22 and the second cylinder portion 81*c* into the through hole 21*a* from outside the storage of the outer box 21. In this case, by the screwing between the male screw 81*b* and the female screw 82*b*, the first flange portion 82*a* is brought into contact with the wall face of the inner box 22 from inside the storage, while the second flange portion 81*a* is brought into contact with the wall face of the outer box 21 from outside the storage.

Also, in this embodiment, the first member 82, the second member 81, and the third member 83 are made of resin, but it is not limited thereto. For example, the third member 83 may be an elastic member that can be pushed into the in-storage pressure regulating path 8*a*. Also, the first member 82 and the second member 81 may be made of metal.

The in-storage pressure regulating device of this embodiment can be provided in the first to third embodiments.

What is claimed is:

1. A refrigerating apparatus comprising:

an insulation housing including an inner box, the inner box having side plates;

a first refrigerating circuit including a first compressor and a first evaporator constituted by a first evaporation pipe; and a second refrigerating circuit including a second compressor and second evaporator constituted by a second evaporation pipe, wherein:

the first and second evaporation pipes are disposed on the side plates of the inner box, the first evaporation pipe is bent so as to form a first comb shape on the side plates and the second evaporation pipe is bent so as to form a second comb shape on the side plates, the first comb shape and the second comb shape forming a nested structure, and the first and second evaporation pipes are configured such that:

the first evaporation pipe includes a first straight portion extending a horizontal direction, a second straight portion extending the horizontal direction and a corner portion connecting the first and second straight portions of the first evaporation pipe, the second evaporation pipe includes a first straight portion extending the horizontal direction, a second straight portion extending the horizontal direction and a corner portion connecting the first and second straight portions of the second evaporation pipe, in the nested structure, the first straight portion of the first evaporation pipe, the first straight portion of the second evaporation pipe, the second straight portion of the second evaporation pipe and the second straight portion of the first evaporation pipe are arranged in this order in a vertical direction, with spaces therebetween, a first distance between the first straight portion of the first evaporation pipe and the first straight portion of the second evaporation pipe and a second distance between the first straight portion of the second evaporation pipe and the second straight portion of the second evaporation pipe are substantially equal, and at least the first and second straight portions of the first evaporation pipe and the first and second straight portions of the second evaporation pipe are not attached to another evaporation pipe extending the horizontal direction.

2. The refrigerating apparatus of claim 1, wherein:

the side plates includes a first side plate, a second side plate and a back plate connecting the first and second plates, the inner box further includes a top plate and an opening disposed opposite to the back plate, the first and second evaporation pipes are disposed on the top plate, the first and second side plates and the back plate, and the first and second evaporation pipes extend from the first and second compressor, respectively, such that a first refrigerant flowing through the first evaporation pipe flows the top plate, the first side plate, the back plate and the second side plate, in this order, and a second refrigerant flowing through the second evaporation pipe flows the top plate, the second side plate, the back plate and the first side plate, in this order.

3. The refrigerating apparatus of claim 2, wherein on the top plate, the first and second evaporation pipes are configured such that:

the first evaporation pipe includes a third straight portion extending a first direction, a fourth straight portion extending the first direction and a corner portion connecting the third and fourth straight portions of the first evaporation pipe, the second evaporation pipe includes a third straight portion extending the first direction, a fourth straight portion extending the first direction and a corner portion connecting the third and fourth straight portions of the second evaporation pipe, the first evaporation pipe is bent so as to form a third comb shape and the second evaporation pipe is bent so as to form a fourth comb shape, the third comb shape and the fourth comb shape forming a nested structure, in the nested structure, the third straight portion of the first evaporation pipe, the third straight portion of the second evaporation pipe, the fourth straight portion of the second evaporation pipe and the fourth straight portion of the first evaporation pipe are arranged in this order in a direction perpendicular to the first direction, with spaces therebetween, and a third distance between the third straight portion of the first evaporation pipe and the third straight portion of the second evaporation pipe and a fourth distance between the third straight portion of the second evaporation pipe and the fourth straight portion of the second evaporation pipe are substantially equal.

4. The refrigerating apparatus of claim 1, wherein the inner box has curved corners between adjacent two of the side plates, the curved corners are formed in such a manner that a radius of curvature of the curved corners is substantially equal to a radius of curvature of the first and second evaporation pipes at the curved corners.

5. The refrigerating apparatus of claim 1, wherein:

the side plates includes an upper area and a lower area located lower than the upper area, the first and second evaporation pipes are configured such that:

the first evaporation pipe includes a third straight portion extending the horizontal direction, a fourth straight portion extending the horizontal direction and a corner portion connecting the third and fourth straight portions of the first evaporation pipe, the second evaporation pipe includes a third straight portion extending the horizontal direction, a fourth straight portion extending the horizontal direction and a corner portion connecting the third and fourth straight portions of the second evaporation pipe, in the nested structure, the third straight portion of the first evaporation pipe, the third straight portion of the second evaporation pipe, the fourth straight portion of the second evaporation pipe and the fourth straight portion of the first evaporation pipe are arranged in this order in the vertical direction, with spaces therebetween, and a third distance between the third straight portion of the first evaporation pipe and the third straight portion of the second evaporation pipe and a fourth distance between the third straight portion of the second evaporation pipe and the fourth straight portion of the second evaporation pipe are substantially equal, and the first and second distances are smaller than the third and fourth distances.

6. The refrigerating apparatus of claim 1, wherein in the nested structure:

a distance between the first evaporation pipe and the second evaporation pipe adjacent to the first evaporation pipe located in an upper area of the side plates is smaller than a distance between the first evaporation pipe and the second evaporation pipe adjacent to the first evaporation pipe located in a lower area of the side plates, a distance between the first evaporation pipe and an adjacent first evaporation pipe located in the upper area of the side plates is smaller than a distance between the first evaporation pipe and the adjacent first evaporation pipe located in the lower area of the side plates, and a distance between the second evaporation pipe and an adjacent second evaporation pipe located in the upper area of the side plates is smaller than a distance between the second evaporation pipe and the adjacent second evaporation pipe located in the lower area of the side plates.

7. The refrigerating apparatus of claim 1, wherein:

the inner box has a first side plate, a second side plate and a first curved corner connecting the first and second side plates, the first evaporation pipe includes a first portion extending a horizontal direction and a second portion extending a vertical direction, the first portion of the first evaporation pipe is disposed so as to contact to the first and second side plates and the first curved corner of the inner box, and the second portion of the first evaporation pipe is disposed outside of the first portion of the first evaporation pipe at the first curved corner so that the first portion of the first evaporation pipe locates between the first curved corner and the second portion of the first evaporation pipe.

8. The refrigerating apparatus of claim 7, wherein:

the second evaporation pipe includes a first portion extending the horizontal direction and a second portion extending the vertical direction, the inner box has a third side plate and a second curved corner connecting the second and third side plates, the first portions of the first and second evaporation pipes are disposed so as to contact to the first, second and third side plates and the first and second curved corner of the inner box, the second portion of the first evaporation pipe is disposed outside of the first portions of the first and second evaporation pipes at the first curved corner, so that the first portions of the first and second evaporation pipes locate between the first curved corner and the second portion of the first evaporation pipe, and the second portion of the second evaporation pipe is disposed outside of the first portions of the first and second evaporation pipes at the second curved corner so that the first portions of the first and second evaporation pipes locate between the second curved corner and the second portion of the second evaporation pipe.

9. The refrigerating apparatus of claim 7, wherein:

the first curved corner is formed in such a manner that a radius of curvature of the first curved corner is substantially equal to a radius of curvature of the first portion of the first evaporation pipe at the first curved corners.

10. The refrigerating apparatus of claim 8, wherein:

the first curved corner is formed in such a manner that a radius of curvature of the first curved corner is substantially equal to a radius of curvature of the first portion of the first and second evaporation pipe at the first curved corners, and the second curved corner is formed in such a manner that a radius of curvature of the second curved corner is substantially equal to a radius of curvature of the first portion of the first and second evaporation pipe at the second curved corners.

11. The refrigerating apparatus of claim 1, wherein:

the first refrigerating circuit further includes a first condenser, a first flow divider, a first heat exchanger, a second heat exchanger, and a decompressing device, the first refrigerant circuit further includes a mixed refrigerant obtained by mixing at least first to third refrigerants with different evaporation temperatures, the first and the second heat exchanger each include a double pipe to form a first flow passage in an inner pipe of the double pipe, a second flow passage in an outer pipe of the double pipe, and an intermediate port in a piping connecting between the second flow passage of the first heat exchanger and the second flow passage of the second heat exchanger, a high-temperature and high-pressure refrigerant discharged from the first compressor are cooled by the first condenser to liquefy the first refrigerant including a high evaporation temperature into a liquid refrigerant, and thereafter, the liquid refrigerant obtained by dividing a refrigerant in the first flow divider is decompressed, and thereafter supplied to the second flow passage of the first heat exchanger via the intermediate port, evaporated toward one port of the second flow passage, and supplied to a sucking side of the first compressor via the one port of the second flow passage of the first heat exchanger, and a gas-state refrigerant obtained by dividing a refrigerant in the flow divider is supplied to the first flow passage of the first heat exchanger, and thereafter passes through the first flow passage to liquefy the second refrigerant with an evaporation temperature lower than the evaporation temperature of the first refrigerant, and thereafter passes through the first flow passage of the second heat exchanger to liquefy the third refrigerant, and thereafter, via the first decompressing device, passes through the first evaporator to evaporate the second and third refrigerants, and thereafter passes through the second flow passage of the second heat exchanger and the second flow passage of the first heat exchanger, and thereafter departs from the other port of the second flow passage of the first heat exchanger via the one port and arrives at the sucking side of the first compressor, and thereby a refrigerant in the first flow passage of the first heat exchanger and the second heat exchanger and a refrigerant in the second flow passage of the first heat exchanger and the second heat exchanger including a countercurrent relationship, and including a temperature relationship in a manner that the refrigerant flowing through the second flow passage cools the refrigerant flowing through the first flow passage.

12. The refrigerating apparatus of claim 11, wherein a part of the third refrigerant is evaporated in the second flow passage of the second heat exchanger.

13. The refrigerating apparatus of claim 11, wherein the first decompressing device includes a capillary tube, and the capillary tube is wound around a piping extending from the first evaporator to the second heat exchanger.

14. A refrigerating apparatus comprising:

an insulation housing including an inner box, the inner box having side plates;

a first refrigerating circuit including a first compressor and a first evaporator constituted by a first evaporation pipe; and a second refrigerating circuit including a second compressor and second evaporator constituted by a second evaporation pipe, wherein:

the first and second evaporation pipes are disposed on the side plates of the inner box, the first evaporation pipe is bent so as to form a first comb shape on the side plates and the second evaporation pipe is bent so as to form a second comb shape on the side plates, the first comb shape and the second comb shape forming a nested structure, the first and second evaporation pipes are configured such that:

the first evaporation pipe includes a first straight portion extending a horizontal direction, a second straight portion extending the horizontal direction and a corner portion connecting the first and second straight portions of the first evaporation pipe, the second evaporation pipe includes a first straight portion extending the horizontal direction, a second straight portion extending the horizontal direction and a corner portion connecting the first and second straight portions of the second evaporation pipe, in the nested structure, the first straight portion of the first evaporation pipe, the first straight portion of the second evaporation pipe, the second straight portion of the second evaporation pipe and the second straight portion of the first evaporation pipe are arranged in this order in a vertical direction, with spaces therebetween, and a first distance between the first straight portion of the first evaporation pipe and the first straight portion of the second evaporation pipe and a second distance between the first straight portion of the second evaporation pipe and the second straight portion of the second evaporation pipe are substantially equal, the side plates includes a first side plate, a second side plate and a back plate connecting the first and second plates, the inner box further includes a top plate and an opening disposed opposite to the back plate, the first and second evaporation pipes are disposed on the top plate, the first and second side plates and the back plate, and the first and second evaporation pipes extend from the first and second compressor, respectively, such that a first refrigerant flowing through the first evaporation pipe flows the top plate, the first side plate, the back plate and the second side plate, in this order, and a second refrigerant flowing through the second evaporation pipe flows the top plate, the second side plate, the back plate and the first side plate, in this order.

15. The refrigerating apparatus of claim 14, wherein on the top plate, the first and second evaporation pipes are configured such that:

the first evaporation pipe includes a third straight portion extending a first direction, a fourth straight portion extending the first direction and a corner portion connecting the third and fourth straight portions of the first evaporation pipe, the second evaporation pipe includes a third straight portion extending the first direction, a fourth straight portion extending the first direction and a corner portion connecting the third and fourth straight portions of the second evaporation pipe, the first evaporation pipe is bent so as to form a third comb shape and the second evaporation pipe is bent so as to form a fourth comb shape, the third comb shape and the fourth comb shape forming a nested structure, in the nested structure, the third straight portion of the first evaporation pipe, the third straight portion of the second evaporation pipe, the fourth straight portion of the second evaporation pipe and the fourth straight portion of the first evaporation pipe are arranged in this order in a direction perpendicular to the first direction, with spaces therebetween, and a third distance between the third straight portion of the first evaporation pipe and the third straight portion of the second evaporation pipe and a fourth distance between the third straight portion of the second evaporation pipe and the fourth straight portion of the second evaporation pipe are substantially equal.

16. A refrigerating apparatus comprising:

an insulation housing including an inner box, the inner box having side plates;

a first refrigerating circuit including a first compressor and a first evaporator constituted by a first evaporation pipe; and a second refrigerating circuit including a second compressor and second evaporator constituted by a second evaporation pipe, wherein:

the first and second evaporation pipes are disposed on the side plates of the inner box, the first evaporation pipe is bent so as to form a first comb shape on the side plates and the second evaporation pipe is bent so as to form a second comb shape on the side plates, the first comb shape and the second comb shape forming a nested structure, the first and second evaporation pipes are configured such that:

the first evaporation pipe includes a first straight portion extending a horizontal direction, a second straight portion extending the horizontal direction and a corner portion connecting the first and second straight portions of the first evaporation pipe, the second evaporation pipe includes a first straight portion extending the horizontal direction, a second straight portion extending the horizontal direction and a corner portion connecting the first and second straight portions of the second evaporation pipe, in the nested structure, the first straight portion of the first evaporation pipe, the first straight portion of the second evaporation pipe, the second straight portion of the second evaporation pipe and the second straight portion of the first evaporation pipe are arranged in this order in a vertical direction, with spaces therebetween, and a first distance between the first straight portion of the first evaporation pipe and the first straight portion of the second evaporation pipe and a second distance between the first straight portion of the second evaporation pipe and the second straight portion of the second evaporation pipe are substantially equal, the inner box has a first side plate, a second side plate and a first curved corner connecting the first and second side plates, the first evaporation pipe includes a first portion extending a horizontal direction and a second portion extending a vertical direction, the first portion of the first evaporation pipe is disposed so as to contact to the first and second side plates and the first curved corner of the inner box, the second portion of the first evaporation pipe is disposed outside of the first portion of the first evaporation pipe at the first curved corner so that the first portion of the first evaporation pipe locates between the first curved corner and the second portion of the first evaporation pipe, the second evaporation pipe includes a first portion extending the horizontal direction and a second portion extending the vertical direction, the inner box has a third side plate and a second curved corner connecting the second and third side plates, the first portions of the first and second evaporation pipes are disposed so as to contact to the first, second and third side plates and the first and second curved corner of the inner box, the second portion of the first evaporation pipe is disposed outside of the first portions of the first and second evaporation pipes at the first curved corner, so that the first portions of the first and second evaporation pipes locate between the first curved corner and the second portion of the first evaporation pipe, and the second portion of the second evaporation pipe is disposed outside of the first portions of the first and second evaporation pipes at the second curved corner so that the first portions of the first and second evaporation pipes locate between the second curved corner and the second portion of the second evaporation pipe.

17. The refrigerating apparatus of claim 16, wherein:

the first curved corner is formed in such a manner that a radius of curvature of the first curved corner is substantially equal to a radius of curvature of the first portion of the first and second evaporation pipe at the first curved corners, and the second curved corner is formed in such a manner that a radius of curvature of the second curved corner is substantially equal to a radius of curvature of the first portion of the first and second evaporation pipe at the second curved corners.

* * * * *